US008464805B2

(12) United States Patent
Baumann et al.

(10) Patent No.: US 8,464,805 B2
(45) **Date of Patent: *Jun. 18, 2013**

(54) HAND-HELD POWER TOOL FOR PERCUSSIVELY DRIVEN TOOL ATTACHMENTS

(75) Inventors: Otto Baumann, Leinfelden-Echterdingen (DE); Hardy Schmid, Stuttgart (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 304 days.

This patent is subject to a terminal disclaimer.

(21) Appl. No.: 12/922,582

(22) PCT Filed: Nov. 19, 2008

(86) PCT No.: PCT/EP2008/065845

§ 371 (c)(1),
(2), (4) Date: Sep. 14, 2010

(87) PCT Pub. No.: WO2009/112101

PCT Pub. Date: Sep. 17, 2009

(65) Prior Publication Data

US 2011/0017483 A1 Jan. 27, 2011

(30) Foreign Application Priority Data

Mar. 14, 2008 (DE) ..... 10 2008 000 677

(51) Int. Cl.
*B25D 11/10* (2006.01)
*B25D 17/00* (2006.01)

(52) U.S. Cl.
USPC ..... 173/109; 173/201; 173/216

(58) Field of Classification Search
USPC ..... 173/162.1, 201, 216, 109
See application file for complete search history.

(56) References Cited

U.S. PATENT DOCUMENTS

| | | | | | |
|---|---|---|---|---|---|
| 4,284,148 | A | * | 8/1981 | Wanner et al. | 173/109 |
| 4,387,566 | A | * | 6/1983 | Berchowitz | 60/518 |
| 4,719,976 | A | * | 1/1988 | Bleicher et al. | 173/109 |
| 5,025,562 | A | * | 6/1991 | Palm | 30/392 |
| 5,052,497 | A | * | 10/1991 | Houben et al. | 173/109 |
| 5,379,848 | A | * | 1/1995 | Rauser | 173/48 |
| 5,435,397 | A | * | 7/1995 | Demuth | 173/109 |
| 6,112,830 | A | * | 9/2000 | Ziegler et al. | 173/109 |
| 6,604,583 | B1 | * | 8/2003 | Van Randen | 173/49 |

(Continued)

FOREIGN PATENT DOCUMENTS

| | | | |
|---|---|---|---|
| EP | 1475190 | A2 | 11/2004 |
| EP | 1779979 | A1 | 5/2007 |
| WO | 2008010467 | A1 | 1/2008 |

*Primary Examiner* — Robert Long
(74) *Attorney, Agent, or Firm* — Maginot, Moore & Beck

(57) ABSTRACT

The invention relates to a hand-held power tool for predominantly percussively driven tool attachments, in particular hammer drills and/or chisel-action hammers. The power tool includes a percussion axis and an intermediate shaft that is parallel to the percussion axis in which a first stroke generating device having a first stroke element for a percussion drive is arranged in or on the intermediate shaft and can be driven by the intermediate shaft. Additionally, at least one other second stroke generating device having at least one second stroke element is provided for driving a counter oscillator. A phase displacement that is different from zero and that is unequal to 180° takes place between a movement of the first stroke element and a movement of at least one second stroke element.

23 Claims, 15 Drawing Sheets

U.S. PATENT DOCUMENTS 6,843,330 B2 * 1/2005 Schmid et al. ..... 173/217
7,475,666 B2 * 1/2009 Heimbecker ..... 123/197.1
7,533,736 B2 * 5/2009 Stirm et al. ..... 173/201
7,588,097 B2 * 9/2009 Kamegai et al. ..... 173/162.1
7,857,074 B2 * 12/2010 Meixner ..... 173/48
8,245,791 B2 * 8/2012 Kriedel et al. ..... 173/162.1
2004/0222001 A1 * 11/2004 Ikuta et al. ..... 173/210
2006/0289183 A1 * 12/2006 Schreiber ..... 173/162.2
2008/0029282 A1 * 2/2008 Ikuta ..... 173/114
2009/0145618 A1 * 6/2009 Duesselberg et al. ..... 173/48
2010/0038104 A1 * 2/2010 Baumann et al. ..... 173/162.1
2010/0051303 A1 * 3/2010 Ullrich et al. ..... 173/48
2010/0108339 A1 * 5/2010 Engelfried et al. ..... 173/114
2010/0270046 A1 * 10/2010 Schlesak et al. ..... 173/109
2011/0005791 A1 * 1/2011 Baumann et al. ..... 173/162.2

* cited by examiner

T - T

U - U

A - A

HAND-HELD POWER TOOL FOR PERCUSSIVELY DRIVEN TOOL ATTACHMENTS

CROSS-REFERENCE TO RELATED APPLICATION

This application is a 35 USC 371 application of PCT/EP2008/065845 filed on Nov. 19, 2008.

BACKGROUND OF THE INVENTION

1. Field of the Invention

The invention relates to a hand-held power tool.

2. Description of the Prior Art

DE 198 51 888 has already disclosed a hand-held power tool for percussively driven insert tools, in particular a rotary hammer and/or chisel hammer, which has an air cushion impact mechanism with an impact axis and an intermediate shaft parallel thereto, with the excitation sleeve of the air cushion impact mechanism being driven by means of a stroke producing device embodied in the form of a wobble drive. The wobble drive includes a wobble plate with a wobble pin formed onto it, which is supported on a drive sleeve by means of a wobble bearing in such a way that the rotation of the intermediate shaft sets the wobble pin into an axial deflecting motion by means of a raceway of the bearing elements that is provided on the drive sleeve and tilted at an angle in relation to the intermediate shaft. Due to reactions of the air cushion impact mechanism, which are caused among other things by mass forces acting on the excitation sleeve, oscillations are produced in the hand-held power tool. These oscillations are transmitted to the housing of the hand-held power tool in the form of vibrations and from there, are transmitted to an operator via the handle of the hand-held power tool. In order to reduce the mass forces, the hand-held power tool of DE 198 51 888 has a counterweight embodied in the form of a counter-oscillator that is driven by means of a second wobble pin formed onto the wobble plate diametrically opposite from the first wobble pin. The diametrically opposed arrangement of the wobble pins produces a phase shift Δ of 180° between the axial deflecting motions of the wobble pins. The mass forces produced by the oscillating deflecting motion of the excitation sleeve are particularly powerful at the dead-center positions, i.e. in the vicinity of the maximum speed changes that occur, as a result of which their compensation is particularly effective with a phase shift Δ of the counter-oscillator of 180° relative to the deflecting motion of the excitation sleeve.

In addition to the mass forces, so-called aerodynamic forces that also excite oscillations occur in air cushion impact mechanisms, among other things due to cyclically changing pressure ratios in the air cushion of the air cushion impact mechanism. Particularly with very lightly constructed excitation sleeves, the aerodynamic forces can even outweigh the mass forces. The maximum of the aerodynamic forces is reached by the compression of the air cushion, typically between 260° and 300° after the front dead center of the axial motion of the excitation sleeve. DE 10 2007 061 716 A1 has disclosed a rotary hammer in which a second wobble pin is formed onto the wobble plate, but in this case encloses an angle not equal to 180° in relation to the first wobble pin for driving the excitation sleeve. This arrangement achieves a phase difference Δ not equal to 180° between a deflection of the excitation sleeve by the first wobble pin and the deflection of a counter-oscillator by the second wobble pin. By suitably selecting the angle orientation, it is possible to optimize the action of the counter-oscillator relative to both oscillation-producing forces, i.e. the mass forces and the aerodynamic forces. The arrangement according to DE 10 2007 061 716 A1, however, is characterized by a sharp limitation on installation space since the counter-oscillator must be situated in the vicinity of the optimum angular position of the second wobble pin, as a result of which the air cushion impact mechanism and required bearing elements limit the available installation space. Furthermore, the second wobble pin executes a nonlinear, complex motion, thus requiring complex bearings to accommodate the wobble pin in the counter-oscillator.

ADVANTAGES AND SUMMARY OF THE INVENTION

The hand-held power tool according to the invention has the advantage that in terms of its phase position, the motion of the counter-oscillator can be matched in a particularly effective way to the effective oscillation-exciting forces resulting from the mass forces and aerodynamic forces.

The separate drive of the counter-oscillator also achieves the advantage that the counter-oscillator can be accommodated in the machine housing in an advantageous way in terms of installation space without requiring particularly complex bearings.

A compact embodiment of a hand-held power tool according to the invention is achieved by means of having the at least one additional second stroke producing device be driven by the intermediate shaft.

In a particularly compact embodiment of a hand-held power tool according to the invention, the first stroke producing device is situated in or on a region of the intermediate shaft oriented toward a drive motor. In this case, the at least one additional stroke producing device is situated in or on a region of the intermediate shaft oriented away from the drive motor.

A hand-held power tool according to the invention—in which a bearing device that is affixed to a machine housing of the hand-held power tool is provided between the first stroke producing device and the at least one additional second stroke producing device in order to support the intermediate shaft in rotary fashion—features a particularly favorable rotational decoupling of the intermediate shaft from the machine housing. The advantage of this is that the transverse forces, which are produced by the two stroke producing devices and act on the intermediate shaft, are each partially introduced on both sides of the bearing device.

A particularly effective drive of the counter-oscillator is achieved through a phase shift Δ not equal to 90°. Preferably, the phase shift Δ between the motion of the first stroke element and the motion of the second stroke element lies between 190° and 260°. In a particularly preferred embodiment, the phase shift Δ lies between 200° and 240°.

A particularly effective embodiment of the counter-oscillator has at least one counter-oscillator mass, which is guided along a linear or nonlinear movement path, in particular along a straight line or arc.

A compact and simultaneously effective embodiment of the counter-oscillator has a center-of-gravity path situated close to the impact axis. In a particularly preferred fashion, the center-of-gravity path is oriented parallel to, preferably coaxial to, the impact axis.

In a preferred modification of the hand-held power tool according to the invention, the second stroke producing device is equipped with a clutch device. This allows the second stroke producing device to be coupled to the first stroke producing device for co-rotation. In particular, it is thus possible for the second stroke producing device to be activated only in selected operating states of the hand-held power tool. For example, the second stroke producing device can be advantageously deactivated in an idle state of the hand-held power tool.

In a preferred embodiment, the clutch device is embodied in the form of a meshing clutch. In a particularly preferred form, an axial movement path is provided between an engaged state and a disengaged state.

In a particularly advantageous embodiment, a stroke of the stroke element of the second stroke producing device changes in linear fashion along the movement path. As a result, the amplitude of the motion of the counter-oscillator can be embodied in a particularly easy-to-adjust fashion.

In another modification of the hand-held power tool according to the invention, the second stroke producing device has an additional deflecting element. Preferably, the additional deflecting element is able to drive a second counter-oscillator. Depending on the position of the additional deflecting element relative to the stroke element of the second stroke producing device, the motion of the additional deflecting element has a second phase shift $\Delta_A$ that in particular differs from the phase shift $\Delta$.

In a particularly compact embodiment of a hand-held power tool according to the invention, the first stroke producing device is embodied in the form of a first wobble drive. The first wobble drive in this case includes a drive sleeve that supports at least one first raceway, a wobble bearing, and a wobble plate. A wobble pin functioning as a stroke element is situated on, preferably formed onto, the wobble plate.

In a preferred embodiment of a hand-held power tool according to the invention, the second stroke producing device is embodied in the form of a second wobble drive. This second wobble drive includes at least one second drive sleeve that supports a second raceway, a second wobble bearing, and a second wobble plate with a wobble pin situated on it.

In a particularly rugged embodiment, the drive sleeve of the first wobble drive and the drive sleeve of the second wobble drive are connected to each other for co-rotation. Preferably, the drive sleeves are embodied of one piece with each other. The connection for co-rotation defines a rotational position of the first raceway relative to the additional second raceway. The definition of the relative rotational position establishes the phase shift $\Delta$ between the motions of the first wobble plate and the second wobble plate.

In a preferred modification, the drive sleeve of the first wobble drive and the drive sleeve of the second wobble drive are detachably connected to each other. In particular, the drive sleeves are detachably connected to each other for co-rotation. In particular, an adjusting device is provided, which can be used to adjustably define the rotational position of the first raceway relative to the second raceway. The adjusting device thus makes it possible to embody an adjustable phase shift $\Delta$ between the motions of the first wobble plate and the second wobble plate.

In another preferred embodiment of a hand-held power tool according to the invention, the second stroke producing device is embodied in the form of a cam drive. In particular, the cam drive, which deflects at least one additional stroke element and is embodied in the form of a cylindrical cam drive with a curved track situated on a circumference surface. The additional stroke element deflects the counter-oscillator along the curved track.

In a preferred modification, the cam drive is embodied in the form of an end-surface cam drive or in the form of a cam drive equipped with a surface profile. A pressing element acts on the counter-oscillator so that the counter-oscillator can be pressed against the surface profile and deflected so that it follows the surface profile.

In another preferred embodiment of a hand-held power tool according to the invention, the second stroke producing device is embodied in the form of a connecting rod drive in which the counter-oscillator is operatively connected to the intermediate shaft by means of a connecting rod.

In another preferred embodiment of a hand-held power tool according to the invention, the second stroke producing device is embodied in the form of a crank drive, in which the counter-oscillator is operatively connected to a crank disk by means of a connecting rod. Preferably, the crank disk is driven by means of the intermediate shaft.

In another preferred embodiment of a hand-held power tool according to the invention, the second stroke producing device is embodied in the form of a slotted link drive in which the counter-oscillator is provided with a slotted link.

In another preferred embodiment of a hand-held power tool according to the invention, the second stroke producing device is embodied in the form of a rocker arm drive in which a cam, in particular situated on the intermediate shaft, drives a rocker arm.

In a preferred modification of the hand-held power tool according to the invention, a motion sequence of the second stroke element has a time behavior that differs from a sinusoidal shape. A time behavior that differs from a sinusoidal shape can be advantageously used to adapt the motion sequence of the counter-oscillator to a time behavior of the oscillation-exciting effective forces.

In another preferred modification of the hand-held power tool according to the invention, a deflection of the first stroke element has a first frequency. A deflection of the second stroke element has a second frequency, in particular one that differs from the first frequency. In a particularly preferred embodiment, the second frequency is in particular approximately half the first frequency. This advantageously achieves an additional degree of freedom for adapting the motion of the counter-oscillator to the time behavior of the oscillation-exciting effective forces.

BRIEF DESCRIPTION OF THE DRAWINGS

Exemplary embodiments of the invention are shown in the drawings and will be described in greater detail in the description that follows.

DESCRIPTION OF THE PREFERRED EMBODIMENTS

Figure 1A:
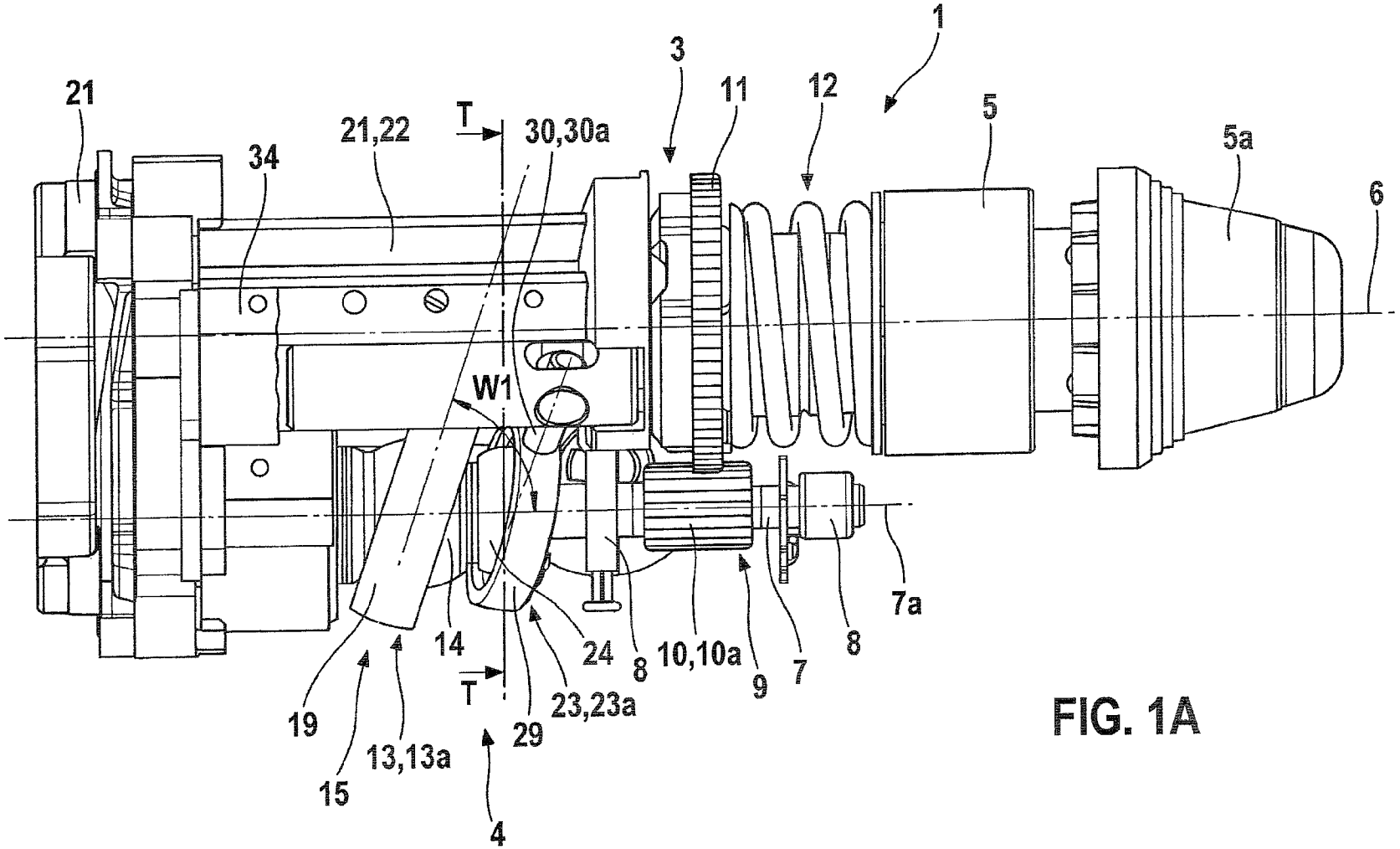
FIG. 1*a* is a side view of a first exemplary embodiment.

FIG. 1*a* shows a side view of a subregion of a rotary hammer 1 as an example of a hand-held power tool according to the invention. The rotary hammer 1 has a machine housing 2, not shown here, which encloses a drive motor, not shown here, and a transmission region 3. The transmission region 3 is accommodated by an intermediate flange 21 via which it is connected to a subregion of the machine housing 2 supporting the drive motor. The transmission region 3 had a transmission device 4 via which a hammer tube 5 can be coupled to the drive motor so that the hammer tube 5 can be driven to rotate. The hammer tube 5 is situated in the transmission region 3 and is supported in rotary fashion in the intermediate flange 21. The hammer tube 5 in this case extends along a machine axis 6 away from the intermediate flange 21. By means of the transmission device 4, a torque produced by the drive motor is transmitted to the hammer tube 5. The transmission device 4 here can also be spoken of as a rotary drive of the hammer tube 5.

To drive the hammer tube 5 in rotary fashion, the transmission device 4 has an intermediate shaft 7 that is situated parallel to the machine axis 6 in the transmission region 3 of the machine housing 2, beneath the hammer tube 5. The intermediate shaft 7 is rotationally decoupled from the machine housing 2 by means of a plurality of bearing devices 8. An output gear 10 embodied in the form of an output spur gear 10*a* is situated in a subregion 9 of the intermediate shaft 7 remote from the drive motor and is connected to the intermediate shaft 7 for co-rotation. A driven spur gear 11 is situated on the hammer tube 5 and meshes with the output spur gear 10*a*. The driven spur gear 11 is operatively connected to the hammer tube 5 via an overload safety clutch 12. If the torque acting on the driven gear 11 is below a threshold torque of the overload safety clutch 12, then the driven gear 11 is connected to the hammer tube 5 for co-rotation. The torque acting on the driven gear 11 is thus transmitted to the hammer tube 5.

At one end of the hammer tube 5, a tool holder 5*a* is provided, into which insert tools, not shown here, can be inserted. In this case, the tool holder 5*a* is connected to the hammer tube 5 for co-rotation. The torque acting on the hammer tube is therefore transmitted to the insert tool by the tool holder 5*a*.

In typical rotary hammers, e.g. of the kind known from DE 198 51 888 C1 and DE 10 2007 061 716 A1, the tool holder 5*a* also produces a limited axial mobility of the insert tool along a tool axis or impact axis defined by a longitudinal span of the insert tool. Typically, the tool axis or impact axis and the machine axis 6 are oriented coaxial to each other so that the term "impact axis 6" is used synonymously with the term "machine axis 6" in the text below.

In addition to the rotary drive of the hammer tube, the transmission device 4 can also drive an air cushion impact mechanism, not shown in detail here, e.g. of the kind known from DE 198 51 888 C1 and DE 10 2007 061 716 A1. In air cushion impact mechanisms of this kind, a piston situated in axially movable fashion inside the hammer tube 5 can be set into an oscillating axial motion so that pressure modulations are produced in a pneumatic spring provided between the end surface of the piston oriented toward an interior of the hammer tube 5 and an end surface of an impact element oriented toward this end surface of the piston, which impact element is likewise situated in axially movable fashion inside the hammer tube 5. As a result, the impact element is accelerated along the impact axis 6.

If the piston moves toward the tool holder, the impact element is accelerated until it strikes an end region of the insert tool. As a result, the impetus of the impact element is transmitted to the insert tool in the form of a hammering impetus.

The transmission device 4 according to the invention from FIG. 1*a* includes a first stroke producing device 13 embodied in the form of a wobble drive 13*a*. The wobble drive 13*a* in this case is situated with a first drive sleeve 14 in a region 15 of the intermediate shaft 7 oriented toward the drive motor. The drive sleeve in this case is preferably connected to the intermediate shaft 6 7 for co-rotation. A first raceway 16, not shown here, is provided on the drive sleeve 14. The raceway 16 in this case is embodied as circular and is tilted in an impact plane containing the impact axis 6 and the intermediate shaft 7 by an angle W1 that is greater than zero and less than 180° and particularly preferably, lies between 45° and 135°. A wobble bearing 17, not shown here, which is preferably embodied in the form of a ball bearing, is situated on this first raceway 16. The wobble bearing 17 includes at least one, but preferably two or more bearing elements 18, which are preferably embodied in the form of balls. The raceway 16 and the wobble bearing 17 are shown most clearly in FIG. 1*c*. A wobble plate 19, which includes the bearing elements 18 of the wobble bearing 17, is situated around the wobble bearing 17. A wobble pin 20, not shown here, is situated on, preferably formed onto, the wobble plate 19. The wobble pin 20 extends away from the intermediate shaft 7 toward the impact axis 6. Its front end, not shown here, is accommodated in a swivel bearing that is provided at the rear end of the piston of the air cushion impact mechanism.

A rotary motion of the intermediate shaft 7 sets the drive sleeve 14 into rotation together with the raceway 16 provided thereon. The wobble bearing 17 is restrictively guided with its bearing elements 18 on the raceway 16 so that the wobble plate 19 is in fact rotationally decoupled from the intermediate shaft 7, but is set into a wobbling motion by the restrictive guidance. As a result of the wobbling motion, the wobble pin 20 executes an oscillating axial motion in the direction of the impact axis 6. The wobble pin 20 here functions as a first stroke element 20*a* of the first stroke producing device 13. The oscillating axial motion of the wobble pin 20 is transmitted via the swivel bearing to the piston of the air cushion impact mechanism.

Figure 1B:
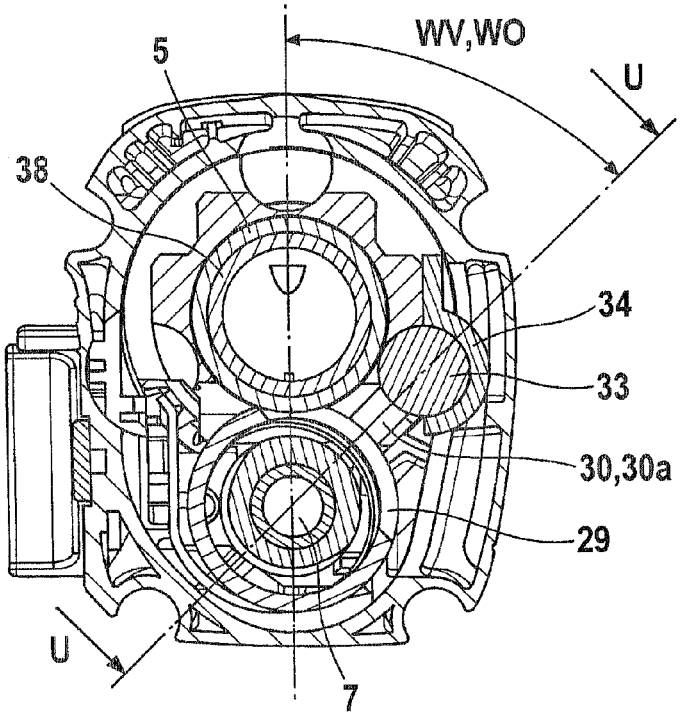
FIG. 1*b* shows a section through the first exemplary embodiment, along the line T-T in FIG. 1*a*.

The transmission device 4 according to the invention from FIG. 1*a* also has a second stroke producing device 23, which in the present exemplary embodiment, is embodied in the form of a second wobble drive 23*a*. The second wobble drive 23*a* is shown most clearly in FIG. 1*c*. The second wobble drive 23*a* in this case is situated on the intermediate shaft 7, at an end surface of the first wobble drive 13*a* oriented away from the drive motor. The design and principle function of the second wobble drive 23*a* are equivalent to those of the above-described first wobble drive 13*a*. In particular, the second wobble drive 23*a* has a second drive sleeve 24 with a second raceway 26; the second drive sleeve 24 is preferably coupled to the intermediate shaft 7 for co-rotation. In addition, a second wobble bearing 27 is provided with bearing elements 28 that are guided along the second raceway 26 and encompassed by a second wobble plate 29. The wobble plate 29 in this case has a second wobble pin 30. The second raceway 26 in this case is tilted in the plane containing the impact axis 6 and the intermediate shaft 7 by an angle W2 that is greater than zero and less than 180° and particularly preferably lies between 45° and 135°. In relation to the first wobble pin 20, the second wobble pin 30 is rotated out from the impact plane by a rotational offset angle WV in the circumference direction of the intermediate shaft 7, as shown in FIG. 1*b*. The second wobble drive 23*a* is adapted to structural boundary conditions in the machine housing 2 through selection of the rotational offset angle WV. In addition, the rotational offset angle WV prevents a possible collision of the first wobble pin 20 with the second wobble pin 30 during operation of the transmission device 4, even with large strokes of the wobble pins 20, 30.

Figure 1C:
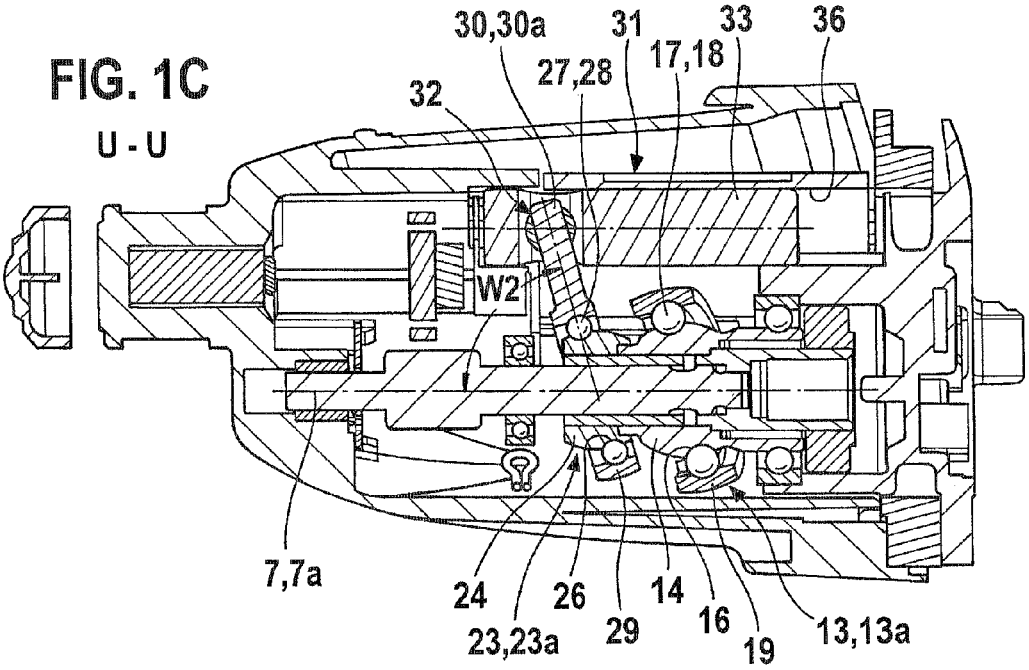
FIG. 1*c* shows a section through the first exemplary embodiment, along the line U-U in FIG. 1*b*, FIGS. 2*a* through 2*d* each show a depiction of the stroke producing devices from FIG. 1*a* in different phases of the motion, FIGS. 3*a* and 3*b* each show a perspective depiction of an alternative counter-oscillator as a second exemplary embodiment.

The end of the wobble pin oriented away from the second wobble plate 29 is accommodated in a counter-oscillator 31. The counter-oscillator 31 can be equipped with a receiving swivel bearing 32, as depicted in FIG. 1*c*, for a low-friction accommodation of the wobble pin 30. In the embodiment shown here, the counter-oscillator 31 is essentially embodied as a counter-oscillator mass 33. The counter-oscillator mass 33 in this case is embodied in the form of a cylindrical mass component. In the first exemplary embodiment, the counter-oscillator 31 is situated in an axially movable fashion on the side of a sleeve-shaped section 22 of the intermediate flange 21. The sleeve-shaped section 22 is provided with a receiving groove 36 for this purpose, in which the cylindrical counter-oscillator mass 33 is accommodated. The counter-oscillator 31 is embraced by a guide element 34, as is shown in FIG. 1*b*. In the present example, the guide element 34 is detachably fastened to the sleeve-shaped section 22 by means of screw connections. The person skilled in the art is also aware of other fastening possibilities such as clamped, detent-engaged, riveted, soldered, or welded connections that can be used to advantage here. The guide element can also be situated for example in the surrounding machine housing 2. By means of the guide element 34 and the receiving groove 36, the counter-oscillator 31 is guided along a linear path, in particular a straight path parallel to the impact axis 6. It can, however, also be advantageous to guide the counter-oscillator 31 on the other path forms, in particular along an arc or other nonlinear path forms such as parabolic, elliptical, or hyperbolic paths. Selecting the most suitable path form for each respective intended use should present no difficulty to the person skilled in the art.

In the present exemplary embodiment, the first drive sleeve 14 and the second drive sleeve 24 are connected to each other for co-rotation. In this case, an orientation angle W0 in the circumference direction of the intermediate shaft 7 between the first raceway 16 and the second raceway 26 is selected to set a rotational position of the raceways relative to each other. In the present preferred embodiment of a hand-held power tool according to the invention, the orientation angle W0 is equal to the rotational offset angle WV of the second wobble pin 20. This is shown, among other things, in FIG. 1*b*. The relative rotational position and the angles W1 and W2 of the first and second wobble pin 20, 30 yields a phase shift Δ between the oscillating axial motions of the two wobble pins 20, 30.

Different connecting techniques can be used to produce a connection for co-rotation.

For a form-locked connection, at its end oriented toward the second drive sleeve 24, the first drive sleeve 14 can be provided with detent elements such as a spur gearing, a gearing on the outer circumference surface, or similar shapes. On the other hand, the second drive sleeve 24 is provided with corresponding receiving elements with which the detent elements engage, particularly during assembly of the transmission device 4, to produce a form-locked connection.

A nonpositive, frictional engagement can be produced, for example, by means of a press fit between the first drive sleeve 14 and the second drive sleeve 24. In addition to this simple nonpositive, frictionally engaged connection, more complex connections, for example including an additional connecting element such as a connecting sleeve, can also possibly be included.

In addition to the form-locked and/or nonpositive, frictionally engaged connections, the person skilled in the art also knows other connecting techniques such as gluing, soldering, or welding that can be used to advantage depending on the circumstances.

In a preferred, particularly inexpensive form, the first drive sleeve and the second drive sleeve can also be manufactured of one piece. In particular, the sintering technique or metal injection molding (MIM) can be used for this.

Figure 10A:
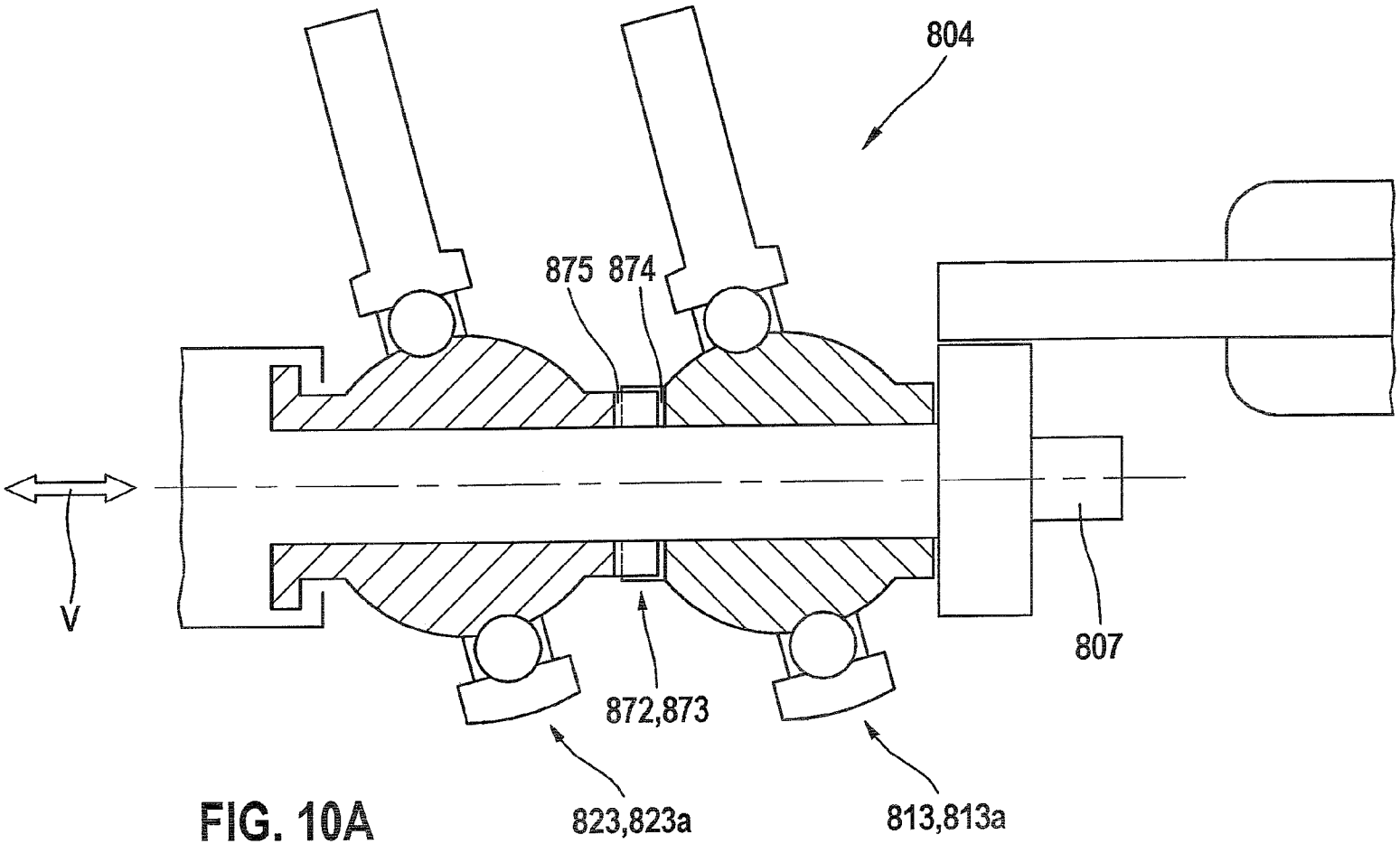
FIG. 10*a* is a schematic side view of a modification of the exemplary embodiment from FIG. 1*a*, as a fifteenth exemplary embodiment.
Figure 10B:
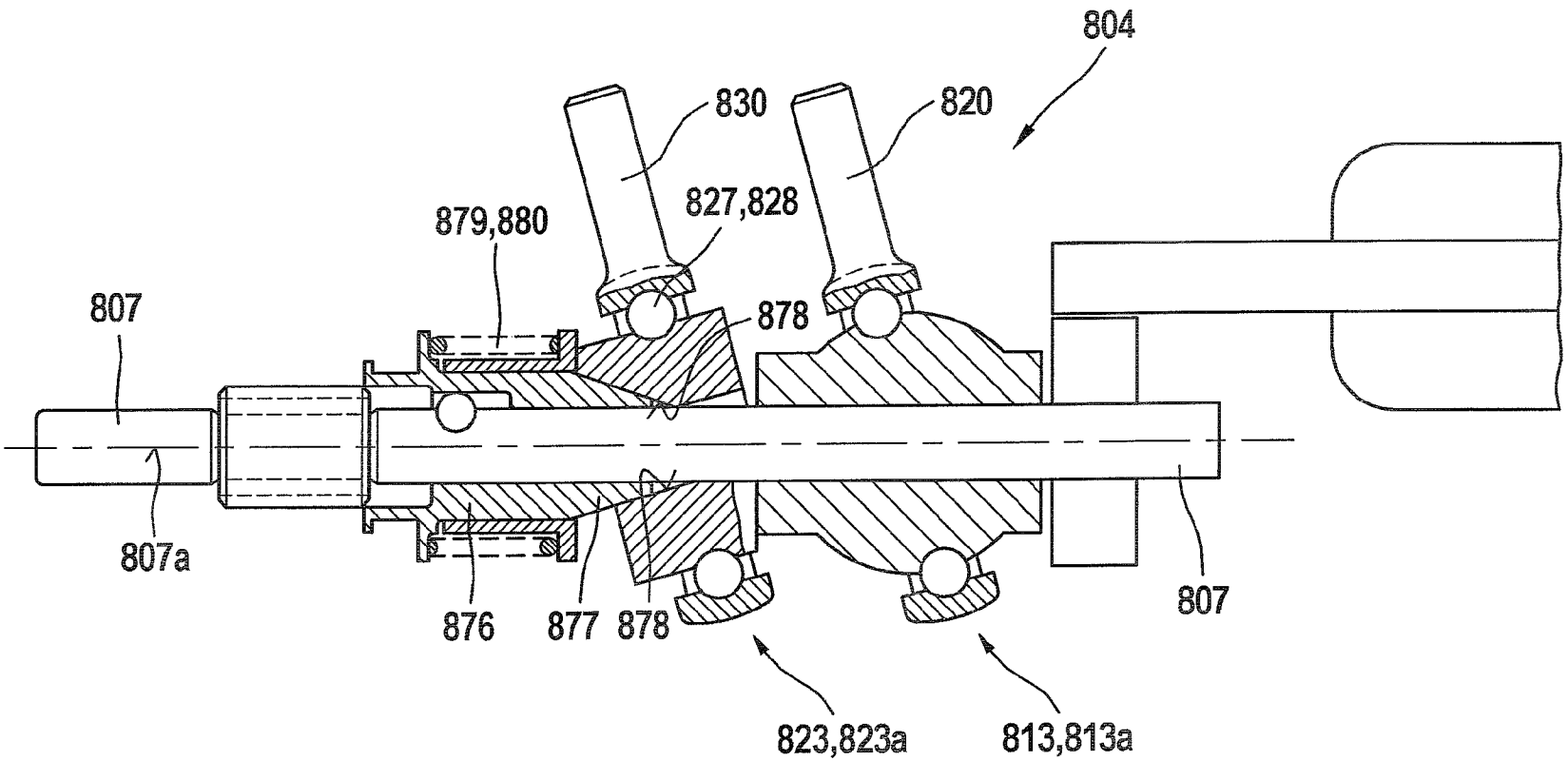
FIG. 10*b* is a schematic side view of another modification of the exemplary embodiment from FIG. 1*a*, as a sixteenth exemplary embodiment.

It can also be advantageous, however, if the connection for co-rotation is embodied as detachable, in particular axially detachable. Possible embodiments are shown in FIGS. 10*a* and 10*b* and described in connection therewith and are included here by reference.

During operation of the rotary hammer 1, the oscillating axial motions of the piston and/or impact element and/or insert tool produce inertial forces when a change occurs in the respective motion state of the piston and/or impact element and/or insert tool, based on their masses. These inertial forces are referred to hereinafter as mass forces. In particular, a change in the motion state of the piston sometimes produces very powerful mass forces. In addition to the kinematic values of the motion sequence such as the instantaneous accelerations, the mass forces depend in particular on the mass of the piston and therefore on its geometry and the material used.

The mass forces act directly on the piston, the impact element, and the hammer tube and excite them to oscillate. Particularly with a sinusoidal motion sequence of the piston, the accelerations at the dead-center positions of the axial motion of the piston are relatively high so that the mass forces demonstrate a pulse-like time behavior and particularly powerful oscillation excitations occur. Because of its direct connection to the motion sequence of the piston, the time behavior is synchronous to the motion state of the piston.

In order to reduce the mass forces of the above-described air cushion impact mechanism, the counter-oscillator 31 is preferably deflected in antiphase to the oscillating axial motion of the piston. In terms of pure mass forces, a phase shift Δ of 180° advantageously prevails between the oscillating axial motion of the piston and the oscillating axial motion of the counter-oscillator 31. In addition to a mass of the counter-oscillator mass 33, the stroke of the oscillating axial motion of the counter-oscillator 31 constitutes a parameter for matching a reducing action of the counter-oscillator 31 to the respective air cushion impact mechanism.

As already described at the beginning, however, mass forces are not the only oscillation-exciting forces at work in air cushion impact mechanisms. Instead, the so-called aerodynamic forces have a considerable influence on an excitation of oscillations. Particularly with an increasing hammering power of the rotary hammer with a simultaneous mass reduction of the moving components such as the piston, the aerodynamic forces assume a dominant role in the excitation of oscillations. As explained above, due to fluid mechanical, effects, the aerodynamic forces are subject to a phase shift in relation to the oscillating axial motion of the piston, which typically lies in the range between 260° and 300° after a front dead center. FDC of the oscillating axial motion of the piston. With the counter-oscillator 31 according to the invention, it is easily possible to optimally select and adjust the phase shift Δ between the oscillating axial motion of the piston and the oscillating axial motion of the counter-oscillator 31. In real air cushion impact mechanisms, the balancing of the phase shift Δ takes into account a chronological behavior of the oscillation-exciting effective forces, which are composed of the mass forces and aerodynamic forces. Preferably, the phase shift Δ lies between 190° and 260°. In a particularly preferred embodiment, the phase shift Δ lies between 200° and 240°.

Figure 2B:
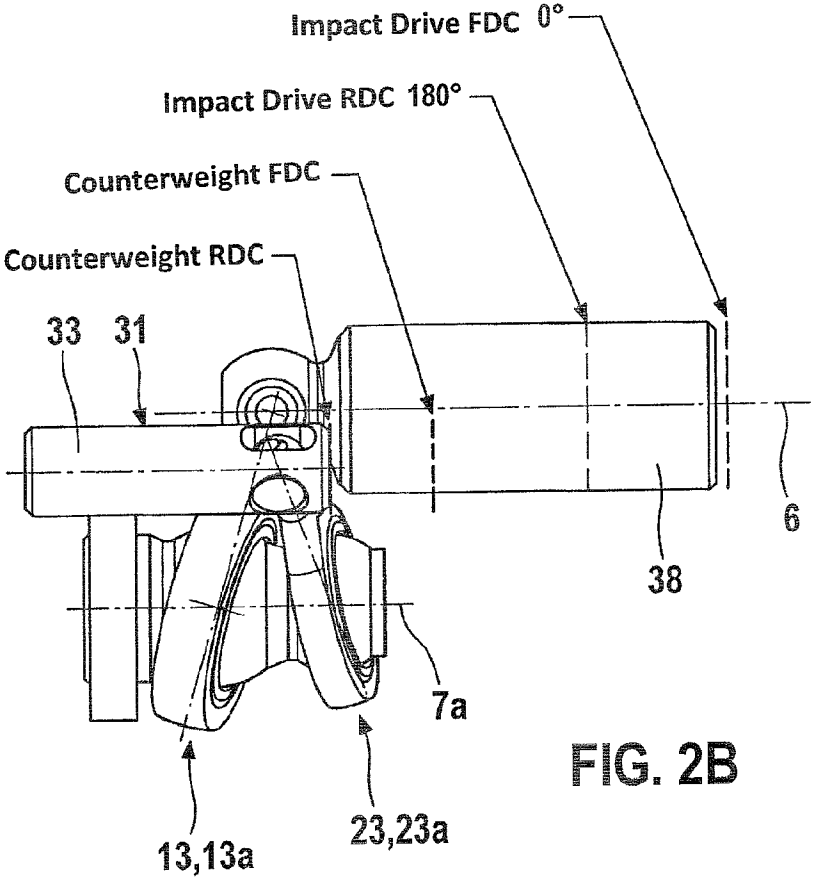
Figure 2A:
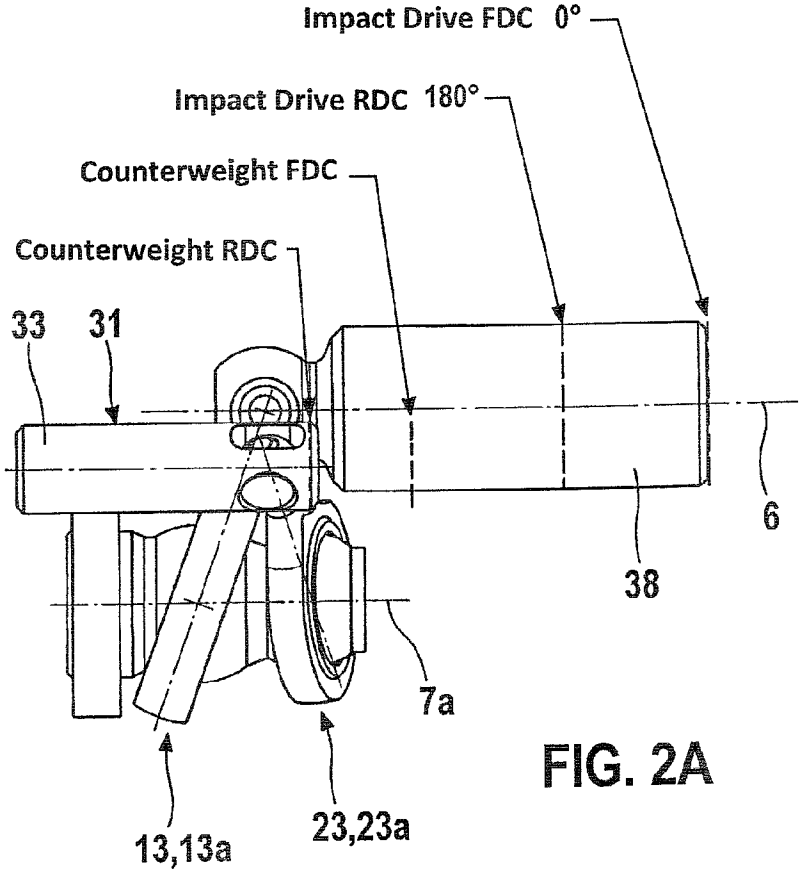
Figure 2D:
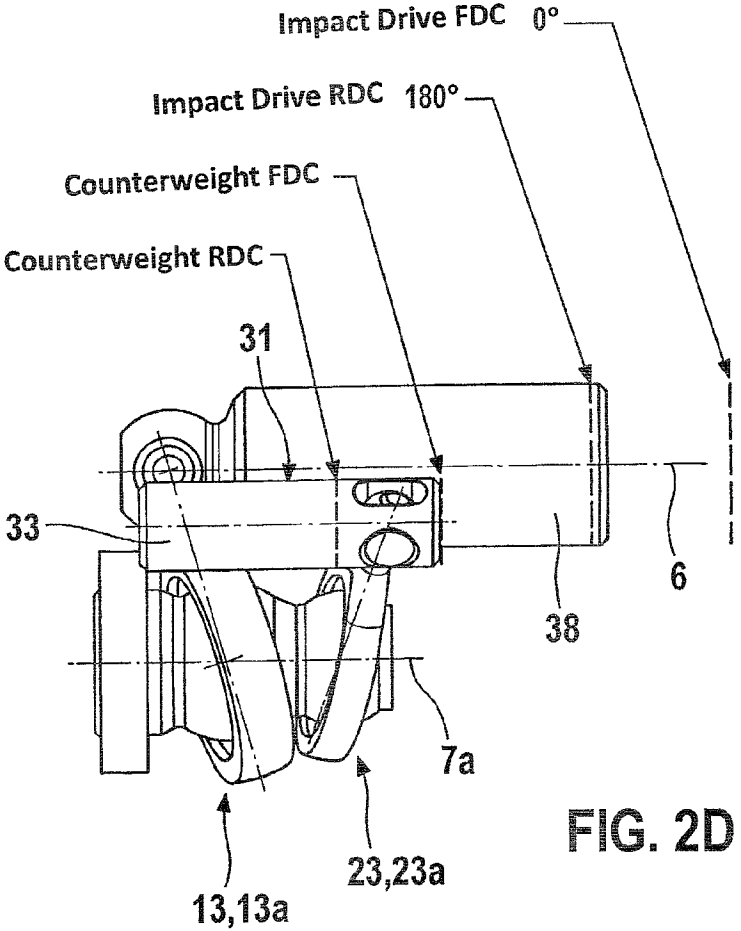
Figure 2C:
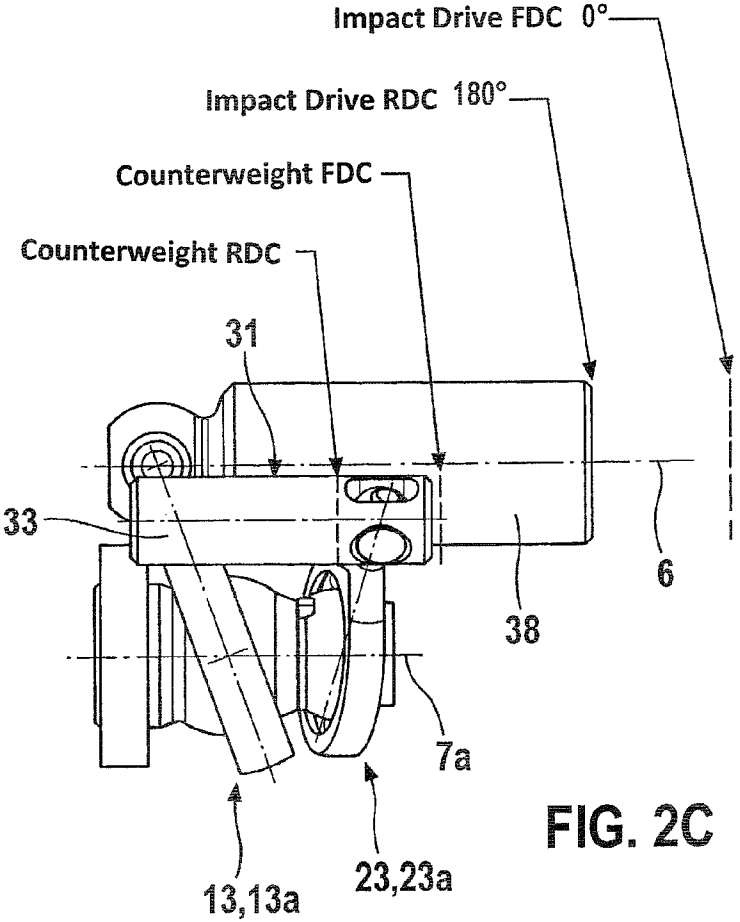

FIGS. 2*a* through 2*d* show an example of the sequence of the oscillating axial motions of a piston 38 and the counter-oscillator 31 and therefore of the first wobble pin 20 and second wobble pin 30, using one case as an example. The figures here show different movement phases. In FIG. 2*a*, the piston 38 is situated in its front dead center, which is labeled "impact drive FDC 0°". At this time, the counter-oscillator 31 is situated to the front of its rear dead center, which is labeled "counterweight RDC". In FIG. 2*b*, the piston 38 is on its way to its rear dead center (labeled "impact drive RDC 180°") while the counter-oscillator 31 has now reached its rear dead center. In FIG. 2*c*, the piston 38 has reached its rear dead center, while the counter-oscillator 31 is still moving toward its front dead center (labeled "counterweight FDC"). Only after the piston 38 has already traveled part of the way to the front dead center as shown in FIG. 2*d* does the counter-oscillator 31 reach its front dead center and reverse its movement direction.

The parameters of counter-oscillator mass, stroke of the counter-oscillator 31, and phase shift Δ constitute optimization parameters that depend on the respective air cushion impact mechanism and can be mathematically and/or experimentally determined.

A preferred modification provides an additional linking element, not shown here, on the second wobble plate 29 of the second wobble drive 23*a*. The additional linking element in this case is preferably situated on, preferably formed onto, the wobble plate 29 at a circumference angle WA in relation to the second wobble pin 30. This linking element is preferably used to drive in particular a second counter-oscillator.

Figure 3A:
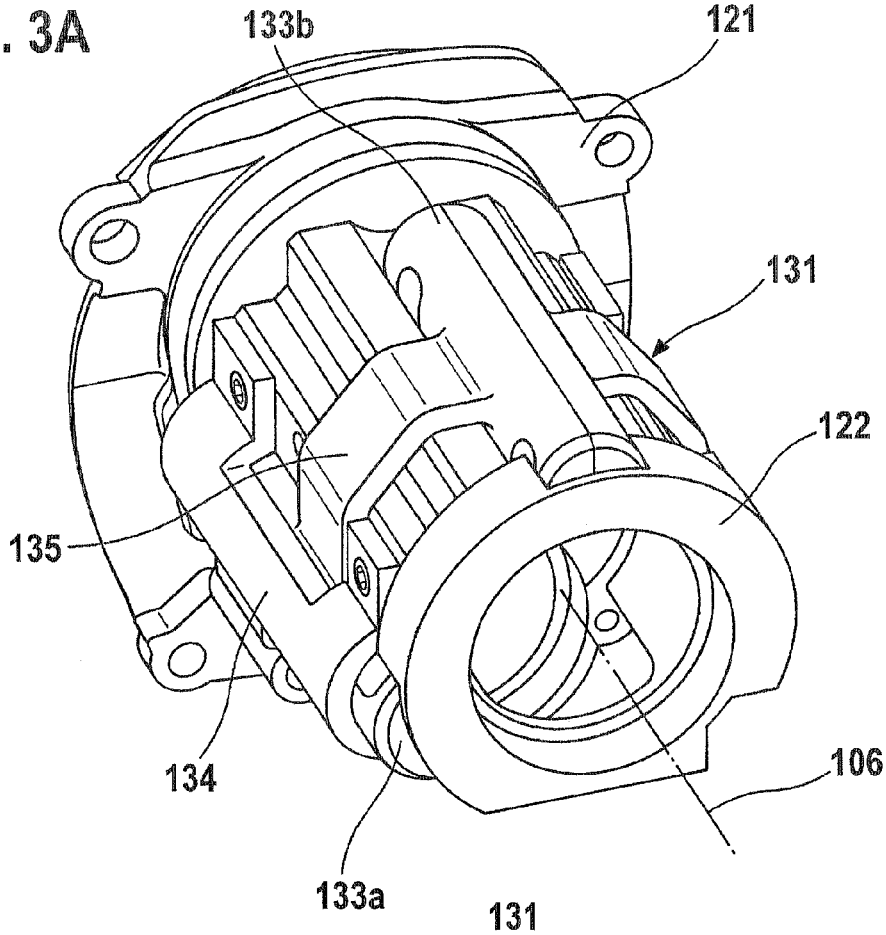
Figure 3B:
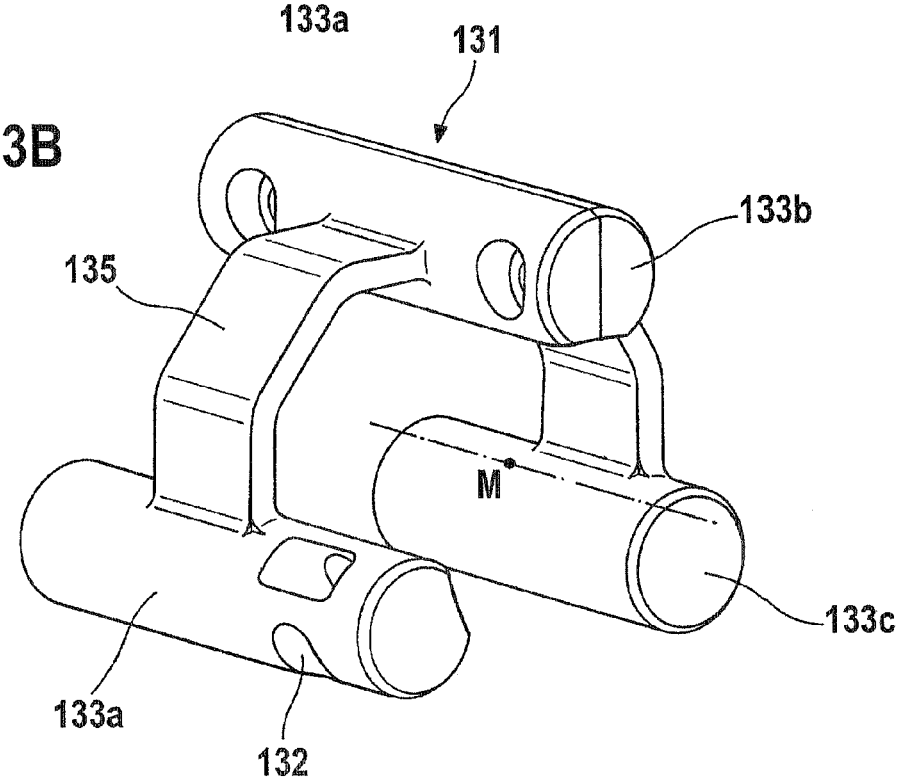

FIGS. 3*a* and 3*b* show perspective views of a modification of the above-described embodiment of a hand-held power tool according to the invention that constitutes a second exemplary embodiment. The reference numerals of parts that are the same or function in the same manner have been increased by 100 in these figures.

FIG. 3*a* shows a counter-oscillator 131 which has three counter-oscillator masses 133*a*, 133*b*, 133*c* connected to one another by means of a bracket-shaped connecting element 135. In the embodiment shown here, the counter-oscillator 131 is composed of two predominantly mirror-symmetrical halves to facilitate assembly. The halves are screwed to each other during assembly. Analogous to the first exemplary embodiment, a receiving swivel bearing 132 is provided in the counter-oscillator mass 133*a* and accommodates the second wobble pin 130 of the second wobble drive 123. The counter-oscillator 131 is arranged around the sleeve-shaped section 122 of the intermediate flange 121 and supported on it in axially movable fashion. To that end, the sleeve-shaped section 122 has receiving grooves 136*a*, 136*b*, 136*c* in which the cylindrical counter-oscillator masses 133*a*, 133*b*, 133*c* are accommodated. Analogous to the first exemplary embodiment, the counter-oscillator 133*a* is secured to and guided on the sleeve-shaped section 122 by means of a guide element 134. In terms of their masses and their positioning, the counter-oscillator masses 133*a*, 133*b*, 133*c* of the second exemplary embodiment are designed so that the counter-oscillator 131 has a centrally situated center of gravity M.

This center of gravity M is situated so that it essentially lies on the impact axis 106. In an oscillating axial motion of the counter-oscillator 131, the center of gravity M describes a center-of-gravity path that is essentially parallel to, preferably coaxial to, the impact axis 106.

The center-of-gravity path of the counter oscillator 131 permits the counter oscillator 131 to counteract the oscillation-exciting effective forces in a particularly effective way since these effective forces act directly on components of the rotary hammer 101, e.g. the piston of the air cushion impact mechanism, which are primarily situated in a cylindrically symmetrical fashion around the impact axis 106 in a known way so that their center-of-gravity paths likewise extend parallel to, primarily even coaxial to, the impact axis 106.

In addition to the three-element embodiment of a counter-oscillator 131 described here, other embodiments of counter-oscillators are known to the person skilled in the art, which permit a counter-oscillator center-of-gravity path that is primarily coaxial to the impact axis 6. In particular, the form and number of counter-oscillator masses 133*a*, 133*b*, 133*c* connected to one another can differ from the embodiment shown here. In an advantageous modification, the counter-oscillator 131 can be embodied in the form of a sleeve-shaped component. Furthermore, modifications of the counter-oscillator 131 shown here can be achieved by differently dividing them into differing halves or other subelements and/or differently attaching them to each other.

Figure 4A:
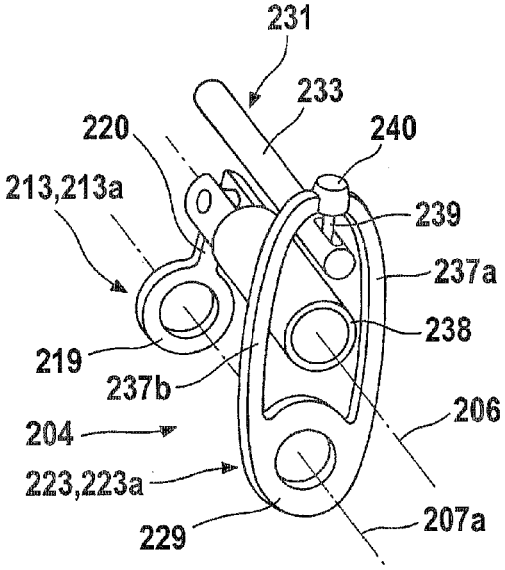
FIG. 4*a* is a perspective schematic depiction of a third exemplary embodiment.

FIG. 4*a* is a schematic, perspective view of a third exemplary embodiment of a transmission device 204 according to the invention. The reference numerals of parts that are the same or function in the same manner have been increased by 100 in this figure. Of the transmission device 204, FIG. 4*a* shows only the first and second stroke producing devices 213, 223 that are situated in the region 215 of the intermediate shaft 207 oriented toward the drive motor; in lieu of the intermediate shaft 207, only an intermediate shaft axis 207*a* is shown. The stroke producing devices in this exemplary embodiment are embodied in the form of a first wobble drive 213*a* and a second wobble drive 223*a*. The first wobble drive

213*a* in this case is embodied in the way known from the preceding exemplary embodiments, rendering its description unnecessary here.

The third exemplary embodiment differs from the preceding exemplary embodiments through a modification of the second wobble drive 223*a*. Two output pins 237*a*, 237*b* are provided on the second wobble plate 229. These output pins 237*a*, 237*b* are laterally connected to, preferably formed onto, the wobble plate 229 in its circumference direction. The output pins 237*a*, 237*b* extend in a bow shape around a piston 238 of the air cushion impact mechanism that is connected to the first wobble pin 220. In the embodiment shown, the output pins 237*a*, 237*b* are mirror-symmetrical in relation to the impact plane, which includes the impact axis 206 and the intermediate shaft axis 207*a*. It can also be advantageous, however, to deviate from this symmetry. At their ends oriented away from the wobble plate 229, the output pins 237*a*, 237*b* are connected to, preferably embodied of one piece with, a pin head 240 that supports an output element 239. The output element 239 is operatively connected to the counter-oscillator 231. In particular, the output element 239 can be accommodated—in a fashion similar to that of the already known second wobble pin 30, 130—in a receiving swivel bearing 232 provided in the counter-oscillator mass 233. Due to this arrangement, the oscillating axial motion of the counter-oscillator 231 is situated in the impact plane. This arrangement makes it unnecessary to rotationally offset a stroke of the second wobble drive 223 in relation to the impact plane. This simplifies tuning and can be advantageous in terms of available space. By contrast with the first two exemplary embodiments, in the third exemplary embodiment, the phase shift Δ between the oscillating axial motion of the piston 238 triggered by the first wobble pin 220 and the oscillating axial motion of the counter-oscillator 231 is determined solely by an angular difference between the angles W1 and W2. The function of the third exemplary embodiment corresponds to that of the first embodiment, whose description is included here by reference.

Figure 4B:
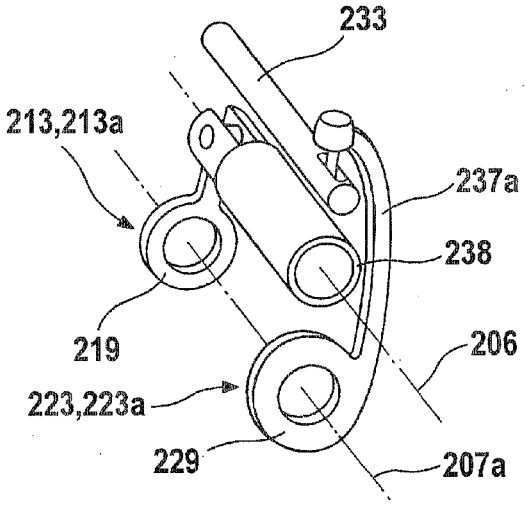
FIG. 4*b* is a perspective schematic depiction of a fourth exemplary embodiment.

FIG. 4*b* shows a fourth exemplary embodiment that is a modification of the third exemplary embodiment from FIG. 4*a*. The depiction here is analogous to the depiction in FIG. 4*a*. The discussion here will concentrate solely on modifications since the basic design and function correspond to those of the third exemplary embodiment.

By contrast with the design of the third exemplary embodiment, the second wobble plate 229 of the second wobble drive 223*a* has an output pin 237*a* on only one side. The output pin 237*a* in this case is bow-shaped. Its end oriented away from the wobble plate 229 is attached to the pin head 240, which supports the output element 239. In this embodiment as well, the counter-oscillator 231 is situated in the impact plane, above the piston 238. The function of the fourth exemplary embodiment corresponds to that of the first embodiment, whose description is included here by reference.

Figure 4C:
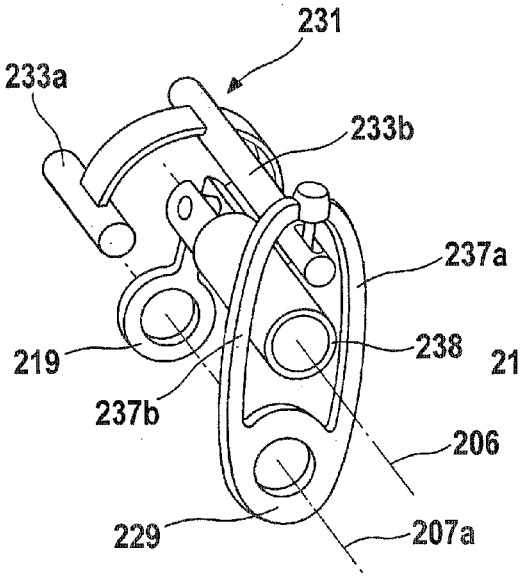
FIG. 4*c* is a perspective schematic depiction of a fifth exemplary embodiment.

FIG. 4*c* is a combination of the second exemplary embodiment from FIG. 3*a* and the third exemplary embodiment from FIG. 4*a*, constituting a fifth exemplary embodiment. The depiction here is analogous to the depiction in FIG. 4*a*. The discussion here will concentrate solely on modifications since the basic design and function correspond to those of the third exemplary embodiment.

By contrast with the third exemplary embodiment, the counter-oscillator 231 of the fifth exemplary embodiment corresponds in design to that of the counter-oscillator 131 known from the second exemplary embodiment. The receiving swivel bearing 232 in the counter-oscillator 231 is provided in the middle counter-oscillator mass 233*b* since analogous to the counter-oscillator 231 in exemplary embodiments three and four, this bearing is situated in the impact plane beneath the pin head 240. Due to its three-element embodiment, the center of gravity M of the counter-oscillator is located centrally between the counter-oscillator masses 233*a*, 233*b*, 233*c*. Suitable selection of the counter-oscillator masses yields a form of the center-of-gravity path that is largely coaxial to the impact axis in an oscillating axial motion of the counter-oscillator.

In a way similar to the one already described in conjunction with the second exemplary embodiment, the person skilled in the art can select forms of the counter-oscillator 231 that differ from the embodiment shown here.

Figure 4D:
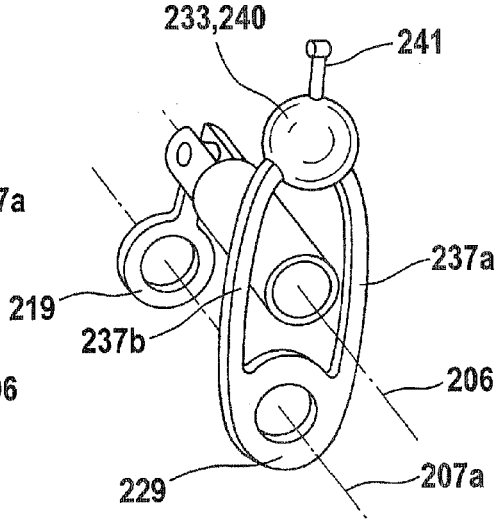
FIG. 4*d* is a perspective schematic depiction of a sixth exemplary embodiment.

FIG. 4*d* is a modification of the third exemplary embodiment from FIG. 4*a*, constituting a sixth exemplary embodiment. The depiction here is analogous to the depiction in FIG. 4*a*. The discussion here will concentrate solely on modifications since the basic design and function correspond to those of the third exemplary embodiment.

In the sixth exemplary embodiment, the pin head 240 of the two output pins 237*a*, 237*b* is itself embodied as a counter-oscillator mass 233. The pin head 240 therefore functions as a counter-oscillator 231. Due to a swiveling motion of the output pins 237*a*, 237*b* triggered by the wobble plate 229, the counter-oscillator in the present instance executes a swiveling motion in the impact plane. The counter-oscillator is in particular guided on an arc-shaped path.

In another modification, alternative to or in addition to the counter-oscillator 231 of the sixth exemplary embodiment, a guide pin 241 can be situated on, in particular formed onto, the pin head 240. This guide pin 241 is preferably oriented away from the wobble plate 229. In addition, a counter-oscillator 231, not shown here, that includes a slotted link 242 can be situated on the guide pin 241. The guide pin 241 protrudes into this slotted link 242 and transmits the oscillating axial motion of the pin head 240 to the counter-oscillator 231 in which the slotted link 242 is provided. An exemplary embodiment of a slotted link 242 is shown in FIG. 8*b*.

Other advantageous embodiments of a second stroke producing device 23 according to the invention, embodied in the form of a second wobble drive 23*a*, 123*a*, 223*a* can be composed, among other things, of combinations of both the individual features of the exemplary embodiment described above and features of wobble drives known to the person skilled in the art.

Figure 5A:
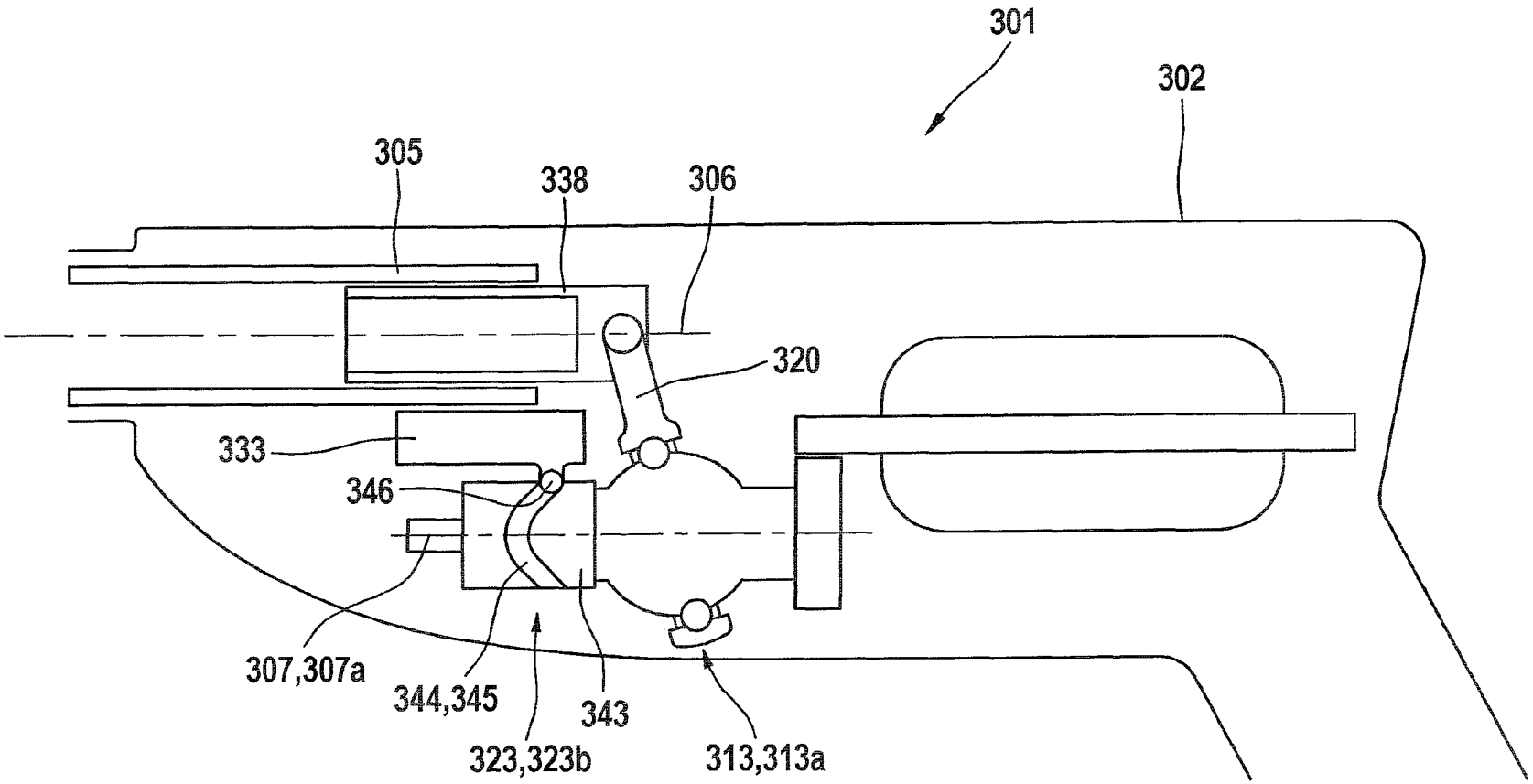
FIG. 5*a* is a schematic side view of a seventh exemplary embodiment.

The following exemplary embodiments of a hand-held power tool according to the invention demonstrate examples with alternative second stroke producing devices of the type that can be advantageously used in the context of the invention:

FIG. 5*a* is a schematic side view of a rotary hammer 301 with a transmission device 304 according to the invention. The reference numerals of parts that are the same or function in the same manner have been increased by 100 in this figure.

The transmission device 304 has a first stroke producing device 313 embodied in the form of a wobble drive 313*a* that is already known from the above-described embodiments. It will therefore not be discussed in detail at this point.

The second stroke producing device 323 for driving a counter-oscillator 331 is embodied in the form of a cam drive 323*b*. In this case, the second stroke producing device 323, 323*b* has a cam cylinder 343 that is situated on the intermediate shaft 307 in its region 309 oriented away from the drive motor and is preferably connected to the intermediate shaft 307 for co-rotation. A curved track 344 is provided on an outer circumference surface of the cam cylinder 343. The curved track has an axial course 345 that varies in the circumference direction of the cam cylinder 343. In particular, the axial course 345 can be comprised of a circular path that is tilted by an angle W3 in relation to the intermediate shaft. Other path forms, in particular nonlinear path forms such as spiral paths, sinusoidal paths, and similar path courses, however, can possibly be advantageous.

In the embodiment shown here, the curved track 344 is embodied in the form of a groove provided in the outer circumference surface of the cam cylinder 343. It is also possible, however, to manufacture a curved track 344 by means of suitable molded or formed-on features. It is also conceivable to manufacture the curved track 344 by encasing or wrapping the cam cylinder with a sleeve element, which is manufactured in a flat arrangement and supports a curved profile. It is then possible, for example, for the sleeve element to be produced by means of stamping and then for it to be rolled into a sleeve. The person skilled in the art is also aware of other methods to accomplish this.

The counter-oscillator 331 has a guide element 346, for example a guide ball 346*a* or a guide pin 346*b*, which is situated on the side of the counter-oscillator oriented toward the cam cylinder. In this case, the guide element 346 is in a predominantly fixed radial position in relation to the cam cylinder 343. The guide element 346 engages in the curved track 344 and is guided by it.

Figure 11A:
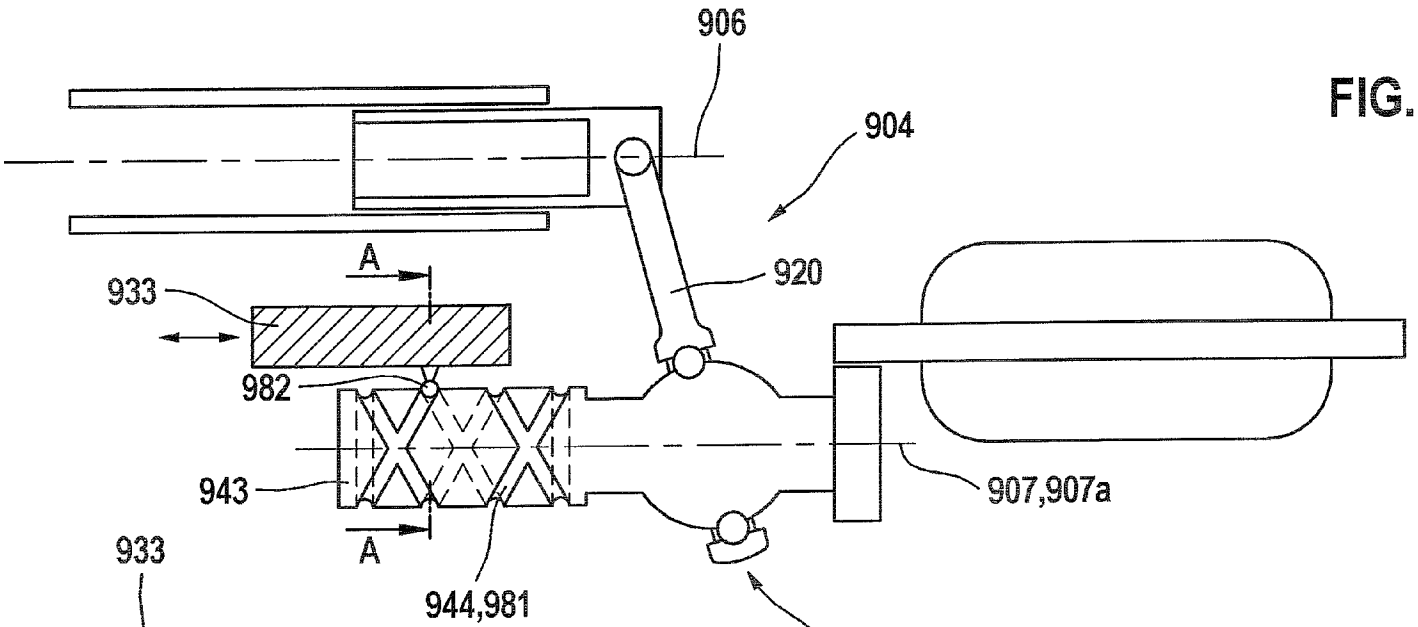
FIG. 11*a* is a schematic side view of a modification of the exemplary embodiment from FIG. 5*a*, as a seventeenth exemplary embodiment.
Figure 11C:
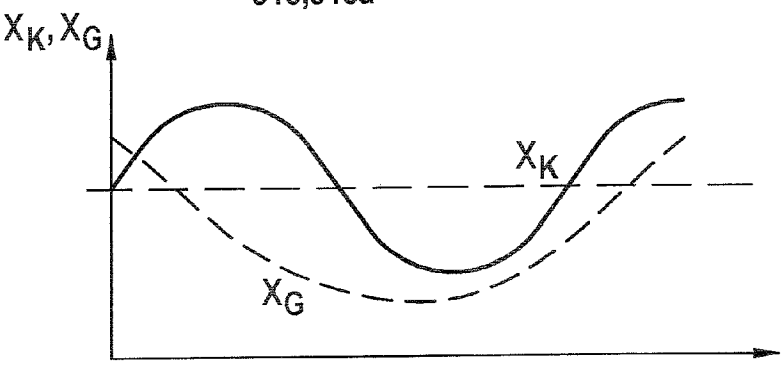
FIG. 11*c* is a schematic depiction of the phase relationship between the motions of the stroke elements according to the exemplary embodiment from FIG. 11*a*.
Figure 11B:
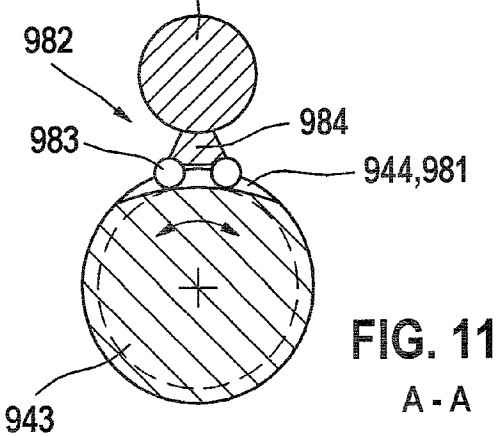
FIG. 11*b* shows a section through the exemplary embodiment from FIG. 11*a*, along the line A-A.

During operation, the cam cylinder 343 is driven to rotate by the intermediate shaft 307. As a result, the guide element 346 is deflected along the axial course 345 of the curved track 344 so that this can be referred to as an oscillating axial motion. Typically, the axial motion of the guide element 346 repeats after one full rotation of the cam cylinder 343. However, it is also possible to provide curved tracks 344 that deviate from this relationship. In particular, the repetition of the axial motion can be an integral multiple or an integral fraction of a rotation of the cam cylinder 343. FIGS. 11*a* through 11*c* show an example of this, the description of which hereinafter is included here by reference.

The oscillating axial motion of the guide element 346 sets the counter-oscillator 331 into an oscillating axial motion. Through a suitable selection of the angle W3 and/or the axial course 345 of the curved track 344, it is possible to set a desired phase shift Δ between the first wobble pin 320 and the guide element 346 functioning as a stroke element 330*a* of the second stroke producing device 323, 323*b*. As a result, the counter-oscillator 331 functions in a fashion analogous to that of the preceding exemplary embodiments. The ability to select the axial course 345 of the curved track 344 provides this exemplary embodiment of a transmission device 304 according to the invention with an additional degree of freedom for optimally matching the oscillating axial motion of the counter-oscillator to the time sequence of the oscillation-exciting effective forces, a degree of freedom which can be advantageously used for further oscillation reduction. In particular, the selection of the curved track 344 or axial course 345 makes it possible to produce a movement profile of the counter-oscillator 331 that differs from a sinusoidal shape that is typical of oscillating motions.

Figure 5B:
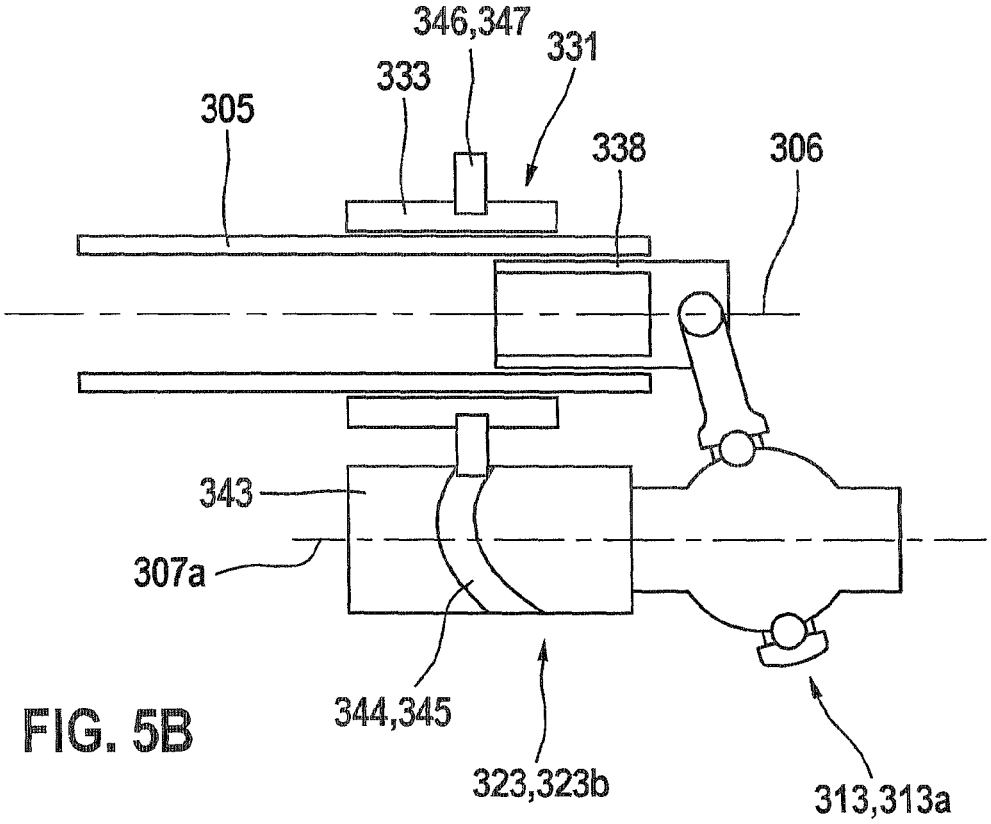
FIG. 5*b* is a schematic side view of an alternative embodiment of the exemplary embodiment from FIG. 5*a*.

FIG. 5*b* is a modification of the exemplary embodiment from FIG. 5*a*, constituting an eighth exemplary embodiment. In this case, the counter-oscillator 331 is embodied in the form of a sleeve-shaped counter-oscillator mass 333. The counter-oscillator 331 is situated at least partially around the hammer tube 305 and is supported so that it is able to slide axially on the latter. The counter-oscillator mass 333 supports a radially protruding guide ring 347 on its circumference. This guide ring 347 can be embodied as a separate component, e.g. as an insert ring, or can be formed directly onto the counter-oscillator mass 333. It is also possible in lieu of the guide ring 347 to use a guide element 346, in particular a guide pin 346*b*, as is already known from FIG. 5*a*.

Similar to the design of the preceding exemplary embodiment, a cam cylinder 343 is situated on the intermediate shaft 307 and its description in conjunction with FIG. 5*a* is included here by reference. The guide ring 347 or guide element 346 engages in the curved track 344 of the cam cylinder 343 on the side of the counter-oscillator oriented toward the intermediate shaft 307. With a rotary motion of the intermediate shaft 307, the guide ring 347 or guide element 346 sets the counter-oscillator 331 into oscillating axial motions that follow the axial course 345 of the curved track 344. The function of this embodiment is therefore equivalent to that of the exemplary embodiment according to FIG. 5*a*. The sleeve-shaped embodiment of the counter-oscillator mass 333 in the present instance, however, has a center-of-gravity path that extends essentially coaxial to the impact axis 306.

Figure 5C:
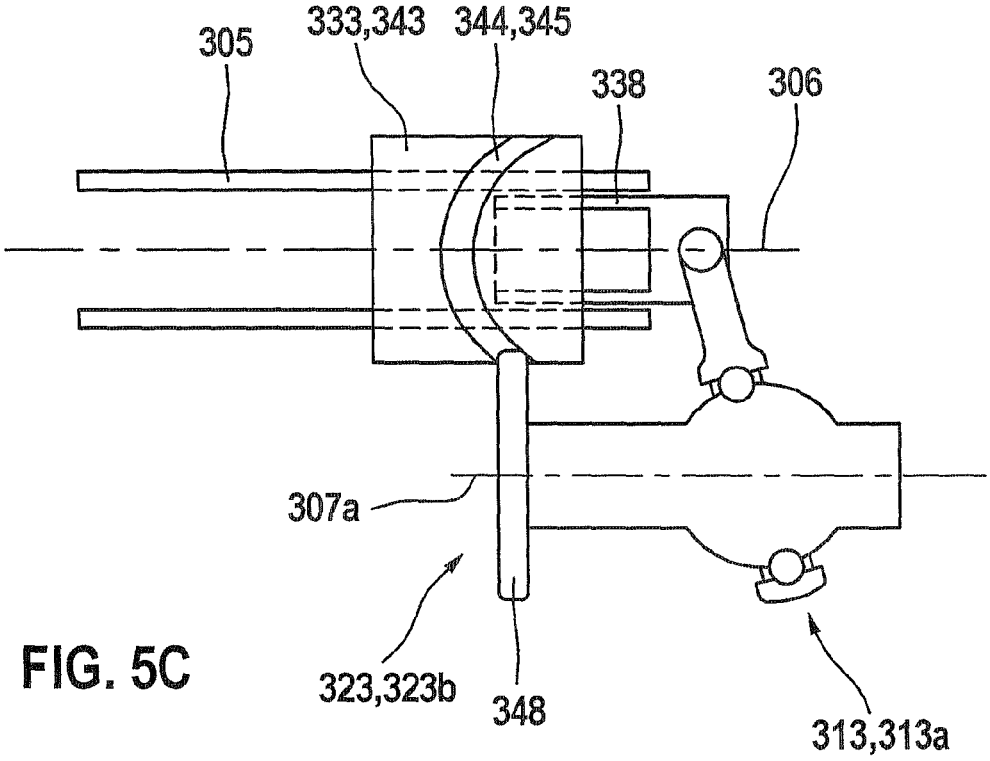
FIG. 5*c* is a schematic side view of another alternative embodiment of the exemplary embodiment from FIG. 5*a*.

FIG. 5*c* is a modification of the exemplary embodiment of a transmission device 304 according to the invention known from FIG. 5*b*, constituting a ninth exemplary embodiment. In this embodiment, the counter-oscillator 331 is provided with a curved track 344 situated on an outer circumference surface of the sleeve-shaped counter-oscillator mass 333; the counter-oscillator mass 333 is supported on the hammer tube 305 in an axially sliding fashion. The possible variations already known from the description of FIG. 5*a* also apply to the embodiment of this curved track 344. A repeat description of them has therefore been omitted here. A drive plate 348 is situated on the part 309 of the intermediate shaft 307 oriented away from the drive motor and can be driven to rotate by the intermediate shaft 307. The drive plate 348 engages in the curved track 344 of the counter-oscillator mass 333 and transmits a rotary motion to the counter-oscillator mass 333. If the counter-oscillator mass 333 is set into rotation, it follows the axial course 345 of the curved track 344 so that in addition to the rotation, it executes an oscillating axial motion. The function of this embodiment corresponds to that of the exemplary embodiment known from FIG. 5*b*; here, too, the sleeve-shaped embodiment of the counter-oscillator 331 makes it possible to implement a center-of-gravity path of the counter-oscillator 331 extending essentially coaxial to the impact axis 306.

Figure 6:
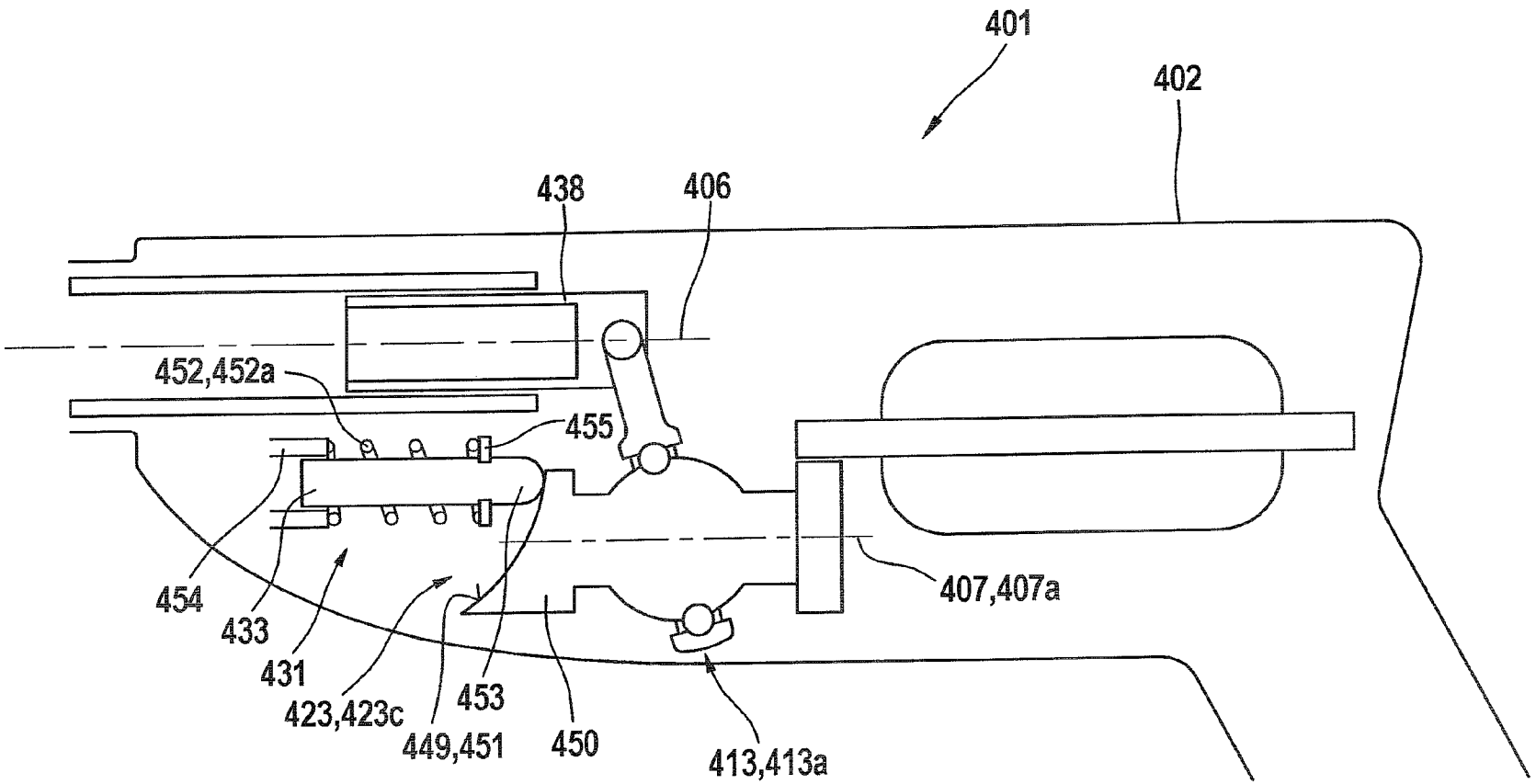
FIG. 6 is a schematic side view of a tenth exemplary embodiment.

FIG. 6 shows a schematic side view of a rotary hammer 401 with a transmission device 404 according to the invention, constituting a tenth exemplary embodiment. The reference numerals of parts that are the same or function in the same manner have been increased by 100 in this figure.

The transmission device 404 has a first stroke producing device 413 in the form of a wobble drive 413*a* already known from the foregoing description. It will therefore not be discussed in detail at this point.

The second stroke producing device 423 for driving a counter-oscillator 431 is embodied in the form of an end-surface cam drive 423*c*. The end-surface cam drive 423*c* has a cam plate 450 that is situated on an end surface perpendicular to the intermediate shaft 307, is oriented away from the drive motor, and has a surface profile 449. It can therefore also be referred to as a cam drive 423*c*. In particular, the surface profile 449 has an axial course 451 that varies in the circumference direction of the cam plate 450.

The counter-oscillator 431 is oriented away from the drive motor and is situated axially in front of the intermediate shaft 307, in particular in front of the cam plate 450 in the machine housing 402. The counter-oscillator 431 here has a pressing element 452 that prestresses the counter-oscillator mass 433 of the counter-oscillator 431 axially in the direction toward the cam plate 450. The pressing element 452 in the present case is embodied in the form of a prestressed helical spring 452*a*. The end of the helical spring 452*a* oriented away from the transmission device rests against a support element 454 affixed to the machine housing 302. Its opposite end rests against a support ring 455 provided on a counter-oscillator mass 433. In this connection, the person skilled in the art is also aware of other pressing elements 452 such as elastomer elements or other spring elements that can be advantageously used in the context of the invention. Support and assembly elements that differ from the form shown here can also be advantageous for the assembly of the pressing element 452.

During operation, this prestressing action presses the counter-oscillator mass 433 against the surface profile 449. The end of the counter-oscillator mass 433 oriented toward the cam plate has a contact element 453 that is pressed against the surface profile in an outer radius region of the cam plate 450. If the intermediate shaft 407 drives the cam plate 450 to rotate, then the counter-oscillator mass 433 is axially deflected by the contact element 453 serving as a stroke element 430*a* of the second stroke producing device 423, 423*c*. Because of the axial course 451 that repeats with a rotation of the cam plate 450, the counter-oscillator 431 executes an oscillating axial motion. It is thus possible by means of the cam profile 449, in particular the axial course 451, to selectively influence the chronological course of the axial motion. In particular, it is possible to produce movement profiles that deviate from a sinusoidal form that is typical for oscillating motions. It is also possible to provide multiple deflections per rotation of the cam plate 450, depending on the cam profile 450.

Figure 7:
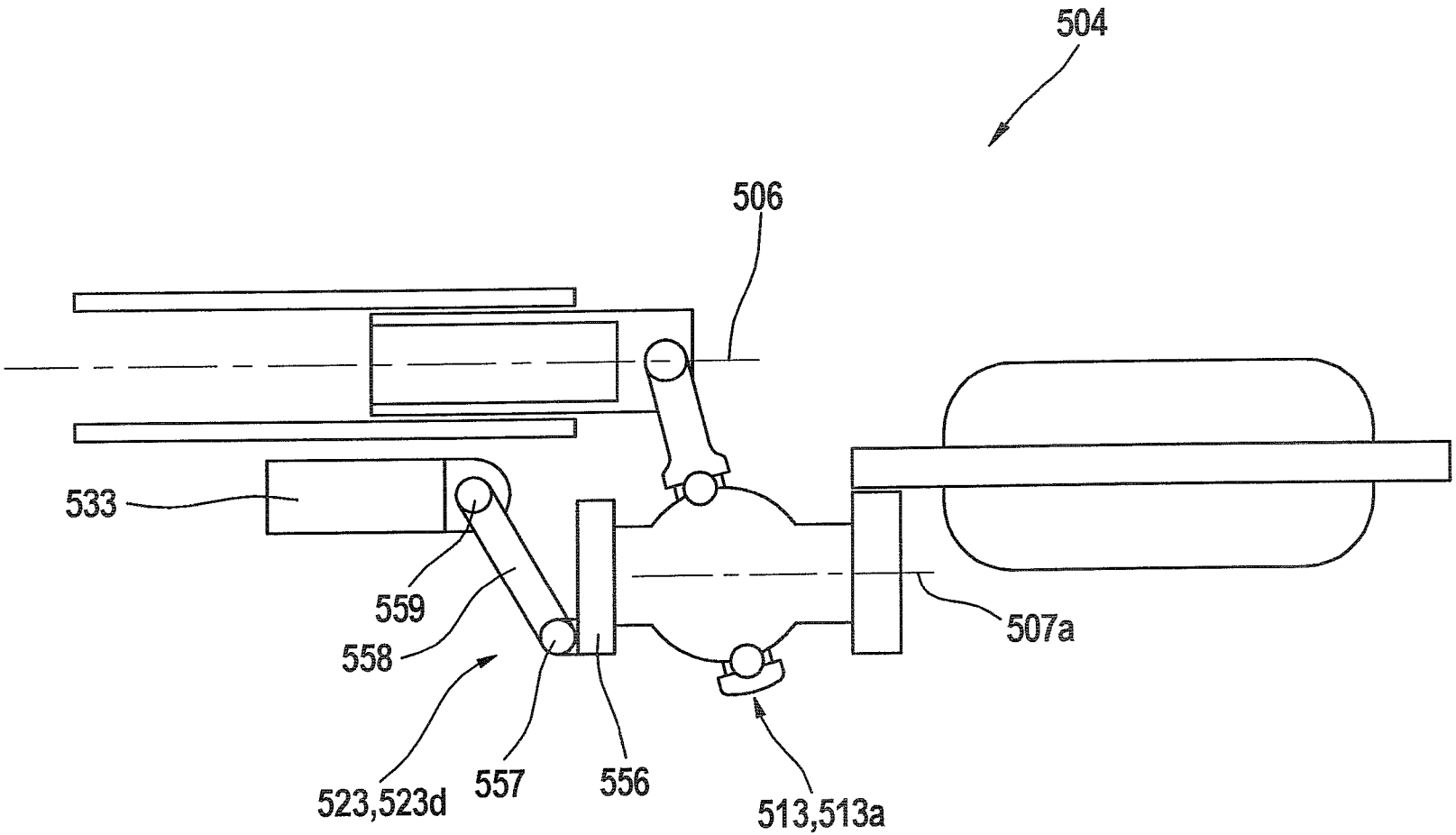
FIG. 7 is a schematic side view of an eleventh exemplary embodiment.

FIG. 7 shows a schematic side view of a rotary hammer 501 with a transmission device 504 according to the invention, constituting an eleventh exemplary embodiment. The reference numerals of parts that are the same or function in the same manner have been increased by 100 in this figure.

The transmission device 504 has a first stroke producing device 513 in the form of a wobble drive 513*a* that is already known from the foregoing description. It will therefore not be discussed in detail at this point.

The second stroke producing device 523 for driving a counter-oscillator 531 is embodied in the form of a connecting rod drive 523*d*. A drive plate 556 is situated on the part 509 of the intermediate shaft 507 oriented away from the drive motor and can be driven to rotate by means of the intermediate shaft 507. A swivel joint 557 is provided in a radially outer region, on an end surface of the drive plate 556. One end of a connecting rod 558 is operatively connected to the drive plate 556 by means of this swivel joint 557. At its other end, the connecting rod 558 is provided with a second swivel joint 559, which operatively connects the connecting rod 558 to the counter oscillator mass 533 of the counter-oscillator 531. The counter-oscillator 531, in particular the second swivel joint 559, is situated spaced radially apart from the intermediate shaft axis 507*a*. Preferably, the counter-oscillator mass 533 is guided so that it can move axially along a path. In a particularly preferred way, this path is a straight line parallel to the impact axis 506.

During operation, the intermediate shaft 507 drives the drive plate 556 to rotate, as a result of which the connecting rod 558 follows the rotary motion via the first swivel joint 557. Due to the axial guidances of the counter-oscillator mass 533, the motion of the connecting rod 558 at the second swivel joint 559 is transmitted in the form of an oscillating axial motion to the counter-oscillator mass 533. The counter-oscillator 31 therefore behaves in a fashion analogous to the already known embodiments.

In this exemplary embodiment, a phase shift Δ is set by means of a circumference angle WU at which the first swivel joint 557 is situated on the drive plate 556 and by means of the position of the second swivel joint 559 relative to the first swivel joint 557. To determine the corresponding parameters, it is assumed that the piston is at its front dead center FDC, as shown in FIG. 7.

Modifications of this embodiment of a transmission device according to the invention are based among other things on the embodiment of the swivel joints 557, 559 and/or the connecting rod 558. In addition, the counter-oscillator mass 533 can be embodied in a wide variety of ways. In particular, the person skilled in the art is easily able to produce advantageous combinations of the exemplary embodiments described above.

Figure 8A:
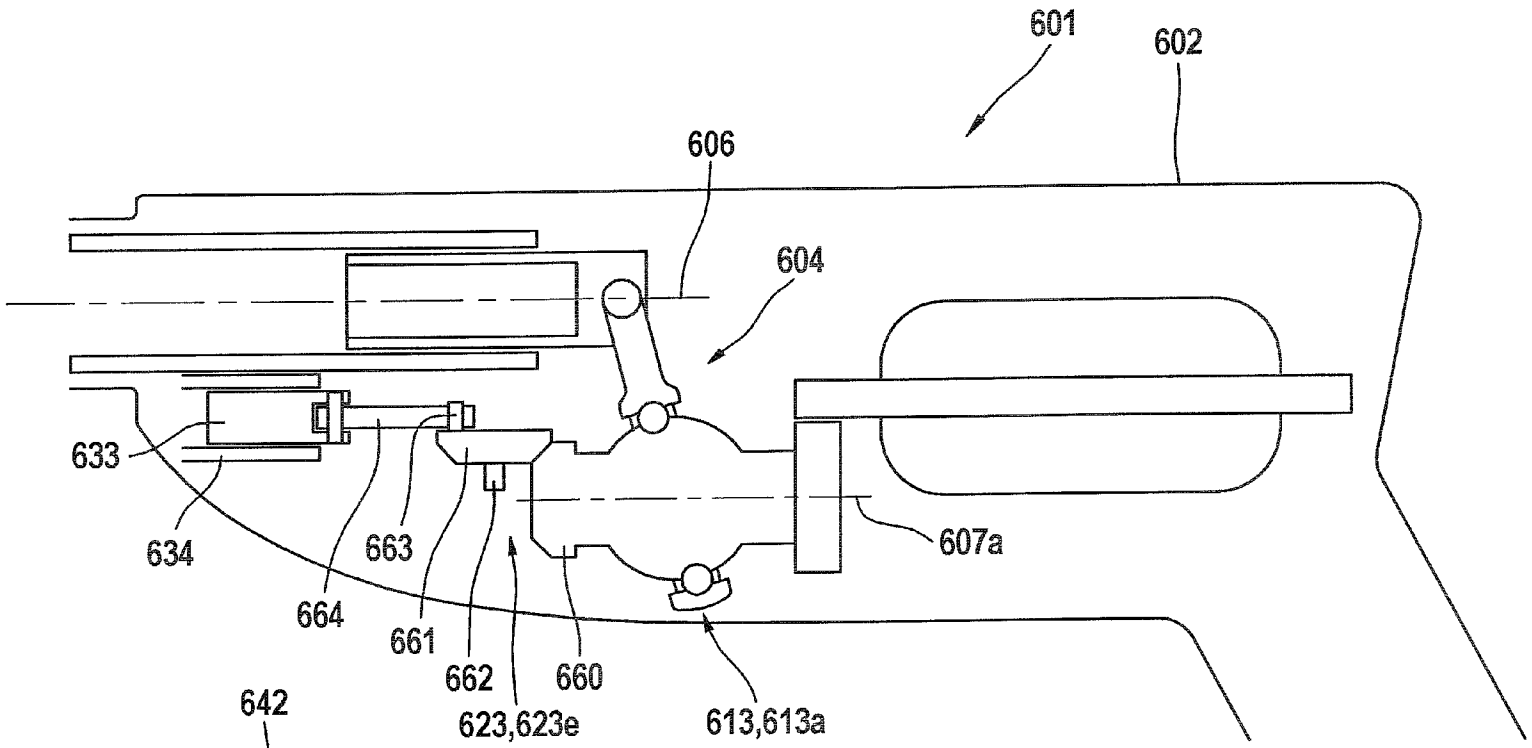
FIG. 8*a* is a schematic side view of a twelfth exemplary embodiment.
Figure 8B:
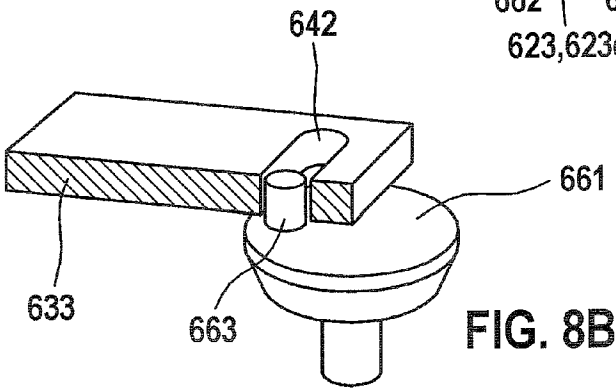
FIG. 8*b* is a schematic side view of a thirteenth exemplary embodiment.

FIG. 8*a* shows a schematic side view of a rotary hammer 601 with a transmission device 604 according to the invention, constituting a twelfth exemplary embodiment. The reference numerals of parts that are the same or function in the same manner have been increased by 100 in this figure.

The transmission device 604 has a first stroke producing device 613 in the form of a wobble drive 613*a* that is already known from the foregoing description. It will therefore not be discussed in detail at this point.

The second stroke producing device 623 for driving a counter-oscillator 631 is embodied in the form of a crank drive 623*e*. To that end, a first bevel gear 660 is situated on the part 609 of the intermediate shaft 607 oriented away from the drive motor and can be driven to rotate by means of the intermediate shaft 607. The first bevel gear 660 meshes with a second bevel gear 661 that is situated on an intermediate gear shaft 662 perpendicular to the intermediate shaft 607. An eccentric pin 663 is situated on, preferably formed onto, a radially outer region of the second bevel gear 661. The second bevel gear 661 therefore functions as a cam plate 661*a*. It is also possible, by extrapolating from the form shown here, for the cam pin 663 to be situated on an eccentric wheel that is likewise situated on the intermediate gear shaft 662 and preferably connected to it for co-rotation. Embodiments of this kind have long been known to the person skilled in the art, rendering their description at this point unnecessary.

The counter-oscillator 631 is situated axially in front of the first bevel gear 660 in the machine housing 602. The movably supported counter-oscillator mass 633 in this case is provided in an axial guide preferably extending parallel to the impact axis 606. At its end oriented toward the first bevel gear 660, the counter-oscillator mass is operatively connected to the eccentric pin 663 by means of a connecting rod 664.

During operation, the first bevel gear 660 is driven to rotate by the intermediate shaft 607. As a result, the second bevel gear 661 sets the eccentric pin 663 into motion, which then causes the counter-oscillator mass 633 to execute an oscillating axial motion. The counter-oscillator 631 therefore behaves in a fashion analogous to the embodiment known from FIG. 1*a*. In this exemplary embodiment, a phase shift Δ is set by means of a circumference angle WE of the eccentric pin 663 on the second bevel gear 661.

FIG. 8*b* shows a modification of the embodiment in FIG. 8*a*, constituting a thirteenth exemplary embodiment. In this embodiment, a slotted link 642 is provided in the counter-oscillator mass 633 and the eccentric pin 663 engages directly in it. During operation, the reciprocating motion of the eccentric pin 663 in the slotted link 642 sets the counter-oscillator mass 633 into an oscillating motion. The movement path of the counter-oscillator mass 633 in this case depends on the form of the slotted link, in particular its axial course 665. In this exemplary embodiment, a phase shift Δ is set by means of a circumference angle WE of the eccentric pin 663 on the second bevel gear 661 and by means of the design of the slotted link 642, in particular its axial course 665.

Figure 9:
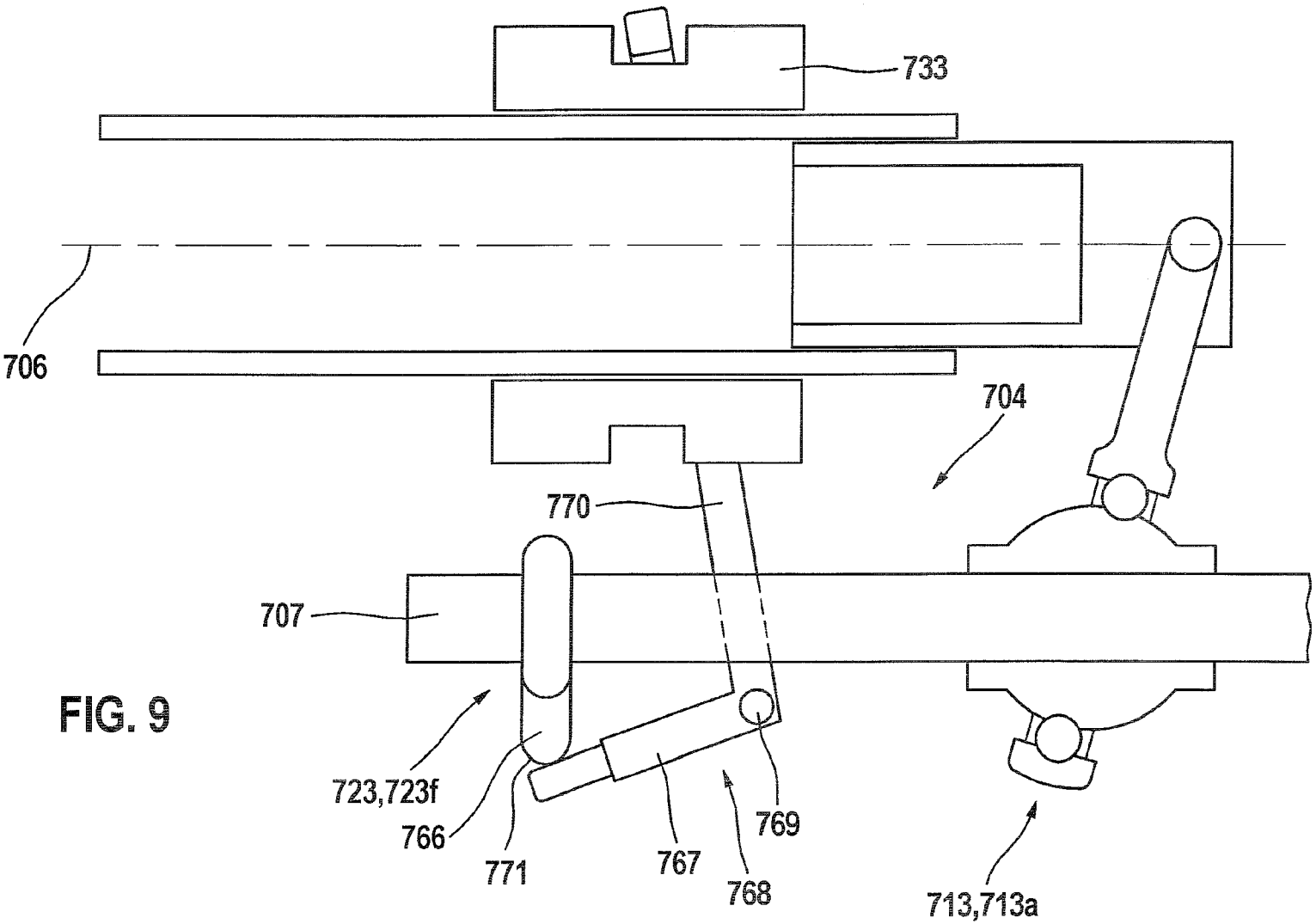
FIG. 9 is a schematic side view of a fourteenth exemplary embodiment.

FIG. 9 shows a schematic side view of a rotary hammer 701 with a transmission device 704 according to the invention, constituting a fourteenth exemplary embodiment. The reference numerals of parts that are the same or function in the same manner have been increased by 100 in this figure.

The transmission device 704 has a first stroke producing device 713 in the form of a wobble drive 713*a* that is already known from the foregoing description. It will therefore not be discussed in detail at this point.

The second stroke producing device 723 for driving a counter-oscillator 731 is embodied in the form of a rocker arm drive 723*f*. To that end, an eccentric cam wheel 766 is situated on the part 709 of the intermediate shaft 707 oriented away from the drive motor and can be driven to rotate by means of this shaft. A first lever arm 767 of a rocker arm 768 is situated beneath the intermediate shaft 707, viewed from the direction of the impact axis 706. The one end of the first lever arm 767 is supported in swiveling fashion in a swivel bearing 769. The swivel bearing 769 in the embodiment shown here is likewise affixed to the machine housing beneath the intermediate shaft 707. A cam profile 770 of the eccentric cam wheel 766 acts on a second end of the first lever arm 767 so that the first lever arm 767 executes a pitching motion around the swivel bearing 769. The swivel bearing 769 also supports a second lever arm 771 of the rocker arm 768. The latter is preferably rigidly connected to the first lever arm 767 so that the pitching motion is transmitted to the second lever arm 771. The counter-oscillator 731 is situated at an end of the second lever arm 771 remote from the swivel bearing 769. The counter-oscillator mass 733 is operatively connected to the second lever arm 771 in such a way that the pitching motion is converted into a motion of the counter-oscillator mass. In the embodiment shown here, the counter-oscillator mass is embodied as sleeve-shaped and is supported in axially movable fashion on the hammer tube 705. The sleeve-shaped embodiment of the counter-oscillator mass 733 makes it possible to achieve a preferred center-of-gravity path coaxial to the impact axis 706.

During operation, the intermediate shaft 707 drives the eccentric cam wheel 766 to rotate so that the pitching motion of the first lever arm 767 caused by the cam profile 770 occurs repeatedly. Due to the operative connection between the second lever arm 771 and the counter-oscillator mass 733, the counter-oscillator mass 733 is driven to execute an oscillating axial motion. Because of the cam profile 770 that returns with a rotation of the eccentric cam wheel 766, the counter-oscillator 731 executes an oscillating axial motion. It is thus possible to selectively influence the chronological progression of the axial motion by means of the cam profile 770. In particular, it is possible to produce motion profiles that deviate from a sinusoidal form that is typical for oscillating motions. It is also possible to provide multiple deflections per rotation of the cam plate 766, depending on the cam profile 770. In this exemplary embodiment, the phase shift Δ is set by adjusting the cam profile 770, particularly with regard to a rotary position relative to the first raceway 716 of the first wobble drive 713*a*.

FIG. 10*a* shows a schematic side view of a modification of the exemplary embodiment from FIG. 1*a*, constituting a fifteenth exemplary embodiment. The reference numerals of parts that are the same or function in the same manner have been increased by 100 in this figure.

This figure depicts stroke producing devices 813, 823 embodied in the form of a first and second wobble drive 813*a*, 823*a*, in a modification based on the exemplary embodiment known from FIG. 1*a*. In this embodiment, only the first drive sleeve 814 is connected to the intermediate shaft 807 for co-rotation. The second drive sleeve 824 is axially movable and can freely rotate on the intermediate shaft 807. In this case, a clutch device 873 embodied in the form of a meshing clutch 872 is provided between the first drive sleeve 814 and the second drive sleeve. An axial movement along a movement path V brings the clutch device 872, 873 into an activated or engaged state so that the second drive sleeve 824 is then connected to the first drive sleeve 814 for co-rotation.

In the embodiment shown here, at least one, but preferably two or more clutch elements 874 are provided on the side of the first drive sleeve oriented toward the second drive sleeve 824. On the side of the second drive sleeve 824 corresponding to this side, at least one, but preferably two or more counterpart clutch elements 875 are provided, to which the clutch elements 874 can be coupled in order to produce a rotational connection between the first drive sleeve 814 and the second drive sleeve 824. To that end, the counterpart clutch elements 875 are brought into engagement with the clutch elements 874 through an axial movement of the second drive sleeve 824. The person skilled in the art is aware of an extremely wide variety of embodiments that can be used for the concrete embodiment of the clutch elements 874 and the counterpart clutch elements 875 that correspond to them. For example, end-surface or circumferential gearings and counterpart gearings can be used. It is also conceivable to provide clutch devices 873 with clutch elements such as balls and ball receptacles, to name just two known embodiments.

Through the integration of a clutch device 872, 873, it is possible to embody the driving of the counter-oscillator 831 so that it can be switched by means of the second wobble drive 823*a*. In particular, it is conceivable for the driving of the counter-oscillator 831 to be deactivated when the rotary hammer 801 is in an idle state. Only when performing a work task, particularly one in which the insert tool is percussively driven, is the driving of the counter-oscillator 831 manually or automatically switched into the operative state.

FIG. 10*b* shows a schematic side view of a modification of the exemplary embodiment from FIG. 10*a*, constituting a sixteenth exemplary embodiment. The embodiment of a meshing clutch 872 shown here is in particular already known from DE 10 2004 007 046 A1, whose description is explicitly included herein by reference. At the end of the intermediate shaft 807 oriented away from the drive motor, an axially movable shifting sleeve 876 is provided, which has a conically tapering shifting wedge 877 at its end oriented toward the second drive sleeve 824. In this embodiment, the second drive sleeve 824 is supported in freely rotating fashion on the intermediate shaft 807. To that end, it has a through bore 878 with a receiving diameter that opens in conical fashion in both directions along the intermediate shaft 807 and each opening has a different cone angle. The side of the through bore oriented toward the shifting sleeve 876 has a cone angle that corresponds to that of the shifting wedge 877.

In an idle state of the rotary hammer 801, the shifting sleeve 876 is held in a disengaged position by means of a return element 879, which is embodied here in the form of a spring element 880. The idle state in this case is defined such that in this state, the insert tool contained in the tool holder 805*a* is not pressed against a work piece. Because the shifting sleeve 876 is positioned in the disengaged state, the shifting wedge 877 is not engaged with the conical receiving diameter that corresponds to it. As a result, the second driving sleeve 824 is not rotationally connected to the intermediate shaft. In addition, the raceway 826 provided on the second driving sleeve 824 is situated in a rest state that is tilted by 90° in relation to the intermediate shaft 807 so that the counter-oscillator 831 is therefore also not subjected to any deflection. If the insert tool is now pressed against a work piece, then the shifting sleeve 876 is slid axially toward the second drive sleeve 824 and the shifting wedge 877 comes into engagement with the corresponding receiving diameter. On the one hand, this produces a rotational connection between the second drive sleeve 824 and the intermediate shaft 807. On the other hand, with a continued sliding of the shifting wedge, the angle W2 of the raceway 826 becomes more sharply inclined relative to the intermediate shaft 807, thus increasing a stroke of the second wobble pin 830. In this case, the cone angle of the other receiving diameter limits the maximum possible angle W2max.

FIG. 11*a* shows a schematic side view of a modification of the exemplary embodiment from FIG. 5*a*, constituting a seventeenth exemplary embodiment. The reference numerals of parts that are the same or function in the same manner have been increased by 100 in this figure.

The second stroke producing device 923, 923*b* has a cam cylinder 943 that is situated on the intermediate shaft 907 in its region 909 oriented away from the drive motor and is preferably connected to the shaft for co-rotation. A curved track 944 is provided on an outer circumference surface of the cam cylinder 943. In the embodiment shown here, the curved path 944 is embodied in the form of a reverse-action criss-crossing spiral track 981. In particular, the spiral track 981 has two respective rotations in each direction. The guide element 946 provided on the counter-oscillator mass 933 is embodied in the form of a rail slider 982, which is shown most clearly in FIG. 11*b*. In the embodiment shown here, the rail slider 982 has at least two guide elements 983, which are preferably embodied in the form of balls. The guide elements 983 are situated in freely rotating fashion on a support element 984 and are spaced apart from each other in the circumference direction of the cam cylinder 943. During operation, the cam cylinder 943 rotates at the same speed as the intermediate shaft 907. By means of the spiral track 981, the axial deflection of the counter-oscillator 931 by means of the rail slider 982 occurs at a reduced speed. In other words, the oscillating axial motion of the second stroke element 30*a* that drives the counter-oscillator occurs with a second, in this case reduced, frequency F2 as compared to a first frequency F1 of the oscillating axial motion of the first wobble pin 920. FIG. 11*c* shows a schematic stroke/time graph for the deflections of the piston and counter-oscillator that correspond to this exemplary embodiment.

As has already been indicated in the description of several of the preceding exemplary embodiments, there are other possibilities for influencing a second frequency F2 of the second stroke producing device 923. Other possibilities for modifying the exemplary embodiments shown here are also known to those skilled in the art.

In a particularly preferred modification, an adjusting device that acts on the raceway 26 of the second drive sleeve 24 is provided, which goes beyond the stroke adjustment for the stroke element 30*a* of the second stroke producing device 23 known from the seventeenth exemplary embodiment. It can therefore be advantageous for the adjusting device to adjust the rotational position of the raceway of the second drive sleeve 24 and therefore the phase shift Δ for the oscillating motion of the stroke element 30*a* of the first stroke producing device 13. To that end, the shifting wedge could be asymmetrically embodied and either manually or by means of an actuator, could be changed in its rotational position relative to the machine housing 2, in particular the impact plane. The person skilled in the art is aware of other ways to implement such an adjusting device.

In particular, such an adjusting device can also be advantageously used in second stroke producing devices 23 that are embodied in the form of cam drives, end-surface cam drives, connecting rod drives, crank drives, or rocker arm drives. In these cases, a rotational position of the cam cylinder (343), the cam plate (450), the drive plate (556), the eccentric pin (663), or the eccentric cam wheel (766) can be varied by means of the adjusting device.

In another preferred modification of a transmission device according to the invention, a bearing device 8 is provided between the first stroke producing device 13 and the second stroke producing device 23. The bearing device 8 in this case is affixed to the machine housing 2. This bearing device 8 is used to support the intermediate shaft 7 in rotary fashion in the machine housing 2.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool for insert tools primarily driven in a percussive fashion comprising:

an impact axis;

an intermediate shaft parallel to the impact axis;

a first stroke producing device for an impact drive that is situated in or on the intermediate shaft, which is configured to be driven by the intermediate shaft, and which has a first stroke element; and at least one additional second stroke producing device, which has at least one second stroke element and which is for driving a counter-oscillator, wherein between a motion of the first stroke element and a motion of the at least one second stroke element, a phase shift is provided that is not equal to zero and is also not equal to 180°.

2. The hand-held power tool as recited in claim 1, wherein the at least one additional second stroke producing device is configured to be driven by the intermediate shaft.

3. The hand-held power tool as recited in claim 1, wherein the first stroke producing device is situated in or on a region of the intermediate shaft oriented toward a drive motor and the at least one additional second stroke producing device is situated in or on a region of the intermediate shaft oriented away from the drive motor.

4. The hand-held power tool as recited in claim 1, wherein the phase shift is not equal to 90°.

5. The hand-held power tool as recited in claim 1, wherein counter-oscillator has at least one counter-oscillator mass that is guided along a linear or nonlinear movement path.

6. The hand-held power tool as recited in claim 1, wherein the counter-oscillator has a center-of-gravity path situated close to the impact axis that is oriented parallel to the impact axis.

7. The hand-held power tool as recited in claim 1, wherein the second stroke producing device is equipped with a clutch device that is able to couple the second stroke producing device to the first stroke producing device for co-rotation.

8. The hand-held power tool as recited in claim 7, wherein the clutch device is embodied in the form of a meshing clutch in which an axial movement path is provided between an engaged state and a disengaged state.

9. The hand-held power tool as recited in claim 8, wherein a stroke of the stroke element of the second stroke producing device changes in linear fashion along the axial movement path.

10. The hand-held power tool as recited in claim 1, wherein the second stroke producing device has in addition a deflecting element that is configured to drive a second counter-oscillator.

11. The hand-held power tool as recited in claim 1, wherein the first stroke producing device is embodied as a first wobble drive, which includes a drive sleeve supporting at least one first raceway, a wobble bearing, and a wobble plate, in which a wobble pin functioning as a stroke element is situated on the wobble plate.

12. The hand-held power tool as recited in claim 11, wherein the second stroke producing device is embodied as a second wobble drive, which includes at least one second drive sleeve supporting a second raceway, a second wobble bearing, and a second wobble plate with a wobble pin situated on the second wobble plate.

13. The hand-held power tool as recited in claim 12, wherein the drive sleeve of the first wobble drive and the drive sleeve of the second wobble drive are connected to each other for co-rotation, and are embodied of one piece with each other, thus defining a rotational position of the first raceway relative to the second raceway.

14. The hand-held power tool as recited in claim 12, wherein the drive sleeve of the first wobble drive and the drive sleeve of the second wobble drive are detachably connected to each other for co-rotation, and an adjusting device is provided to adjustably define a rotational position of the first raceway relative to the second raceway.

15. The hand-held power tool as recited in claim 11, wherein the second stroke producing device is embodied as a cylindrical cam drive with a curved track, which is situated on a circumference surface and deflects the at least one additional second stroke element, in which the at least one second stroke element deflects the counter-oscillator along the curved track.

16. The hand-held power tool as recited in claim 15, wherein the cam drive is embodied as an end-surface cam drive or as a cam drive equipped with a surface profile, in which a pressing element acts on the counter-oscillator, making it possible for the counter-oscillator to be pressed against the surface profile and deflected so that it follows the surface profile.

17. The hand-held power tool as recited in claim 11, wherein the second stroke producing device is embodied as a connecting rod drive in which the counter-oscillator is operatively connected to the intermediate shaft by means of a connecting rod.

18. The hand-held power tool as recited in claim 11, wherein the second stroke producing device is embodied as a crank drive, in which the counter-oscillator is operatively connected to a crank disk by means of a connecting rod.

19. The hand-held power tool as recited in claim 11, wherein the second stroke producing device is embodied as a slotted link drive in which the counter-oscillator is provided with a slotted link.

20. The hand-held power tool as recited in claim 11, wherein the second stroke producing device is embodied as a rocker arm drive, in which an eccentric cam wheel situated on the intermediate shaft drive a rocker arm.

21. The hand-held power tool as recited in claim 1, wherein a motion sequence of the at least one additional second stroke element has a time behavior that differs from a sinusoidal shape.

22. The hand-held power tool as recited in claim 1, wherein a deflection of the first stroke element has a first frequency and a deflection of the second stroke element of the at least one additional second stroke producing device has a second frequency that differs from the first frequency, and the second frequency is approximately half the first frequency.

23. The hand-held power tool as recited in claim 1, wherein between the first stroke producing device and the at least one additional second stroke producing device, a bearing device is provided, which is affixed to a machine housing of the hand-held power tool and is for supporting the intermediate shaft in rotary fashion in the machine housing.

* * * * *